US008222814B2

(12) United States Patent
Terauchi et al.

(10) Patent No.: US 8,222,814 B2
(45) Date of Patent: Jul. 17, 2012

(54) PLASMA DISPLAY PANEL WITH EXPOSED CRYSTAL PARTICLES AND MANUFACTURING METHOD THEREOF

(75) Inventors: Masaharu Terauchi, Hyogo (JP); Yusuke Fukui, Osaka (JP); Takuji Tsujita, Osaka (JP); Michiko Okafuji, Osaka (JP); Mikihiko Nishitani, Nara (JP)

(73) Assignee: Panasonic Corporation, Osaka (JP)

( * ) Notice: Subject to any disclaimer, the term of this patent is extended or adjusted under 35 U.S.C. 154(b) by 642 days.

(21) Appl. No.: 12/443,821

(22) PCT Filed: Oct. 19, 2007

(86) PCT No.: PCT/JP2007/070452

§ 371 (c)(1),
(2), (4) Date: Mar. 31, 2009

(87) PCT Pub. No.: WO2008/047910

PCT Pub. Date: Apr. 24, 2008

(65) Prior Publication Data

US 2010/0045573 A1 Feb. 25, 2010

(30) Foreign Application Priority Data

Oct. 20, 2006 (JP) ..... 2006-286983

(51) Int. Cl.
*H01J 17/49* (2006.01)

(52) U.S. Cl. ..... 313/587; 313/586; 313/585; 345/60

(58) Field of Classification Search ..... 313/581–587
See application file for complete search history.

(56) References Cited

U.S. PATENT DOCUMENTS

| | | | |
|---|---|---|---|
| 5,770,921 | A | 6/1998 | Aoki et al. |
| 5,993,543 | A | 11/1999 | Aoki et al. |
| 6,242,864 | B1 | 6/2001 | Nakahara et al. |
| 7,166,961 | B2 | 1/2007 | Park |
| 7,253,561 | B2 | 8/2007 | Kim et al. |
| 2005/0264487 | A1 | 12/2005 | Tokunaga et al. |
| 2006/0284559 | A1 | 12/2006 | Naoi et al. |
| 2007/0013306 | A1 | 1/2007 | Hai et al. |

(Continued)

FOREIGN PATENT DOCUMENTS

| | | |
|---|---|---|
| EP | 2 031 629 | 3/2009 |

(Continued)

OTHER PUBLICATIONS

Grant, Janice L. et al. "Time Resolved Luminescence Spectroscopy of Alkaline Earth Oxides After Pulsed Electron Beam Irradiation. II. Spectra and Thresholds of MgO", pp. 807-812; J. Chem Phys. 90 (2) Jan. 15, 1989 American Institute of Physics.

(Continued)

*Primary Examiner* — Tracie Y Green

(57) ABSTRACT

The present invention improves discharge characteristics of a protective layer in order to provide a PDP that exhibits excellent display performance even if the PDP is of a fine-cell structure. The present invention also provides a manufacturing method for the PDP. In particular, a protective layer 8 is composed of an MgO film layer 81 and an MgO particle layer 82 that is made of MgO particles 16. The MgO particles 16 are formed by burning an MgO precursor and satisfy that a/b≧1.2, where a denotes a spectrum integral value in a wavelength region of a CL spectrum from 650 nm to 900 nm, exclusive of 900 nm, and b denotes a spectrum integral value in a wavelength region of the CL spectrum from 300 nm to 550 nm, exclusive of 550 nm.

19 Claims, 11 Drawing Sheets

U.S. PATENT DOCUMENTS

2007/0216302 A1 9/2007 Hashimoto et al.

FOREIGN PATENT DOCUMENTS

| | | |
|---|---|---|
| EP | 2 031 630 | 3/2009 |
| JP | 5-234519 | 9/1993 |
| JP | 7-296718 | 11/1995 |
| JP | 8-236028 | 9/1996 |
| JP | 8-287833 | 11/1996 |
| JP | 10-125237 | 5/1998 |
| JP | 10-334809 | 12/1998 |
| JP | 2004-134407 | 4/2004 |
| JP | 2004-273452 | 9/2004 |
| JP | 2006-54158 | 2/2006 |
| JP | 2006-59779 | 3/2006 |
| JP | 2006-59780 | 3/2006 |
| JP | 2006-147417 | 6/2006 |
| WO | 2005/098889 | 10/2005 |
| WO | 2007/139183 | 12/2007 |

OTHER PUBLICATIONS

Min-Soo Ko et al.; "Characteristics of MgO Thick Film ProtectiveLayer" Society for Information Display, IDW '06, Proceedings of the 13th International Display Workshops vol. 2, Dec. 7, 2006, Otsu, Japan, pp. 1153-1156.

PLASMA DISPLAY PANEL WITH EXPOSED CRYSTAL PARTICLES AND MANUFACTURING METHOD THEREOF

TECHNICAL FIELD

The present invention relates to a plasma display panel and a manufacturing method therefor. In particular, the present invention relates to a plasma display panel having a protective layer made of MgO and also to a manufacturing method for such a plasma display panel.

BACKGROUND ART

Plasma display panels (hereinafter, referred to as "PDPs") are a type of flat panel displays (FPDs) capable of high-speed display and suitable for upsizing. Because of these advantages, PDPs are widely in practical use in many fields including the field of video display devices and public information display devices.

FIG. 10 is an assembly drawing of a general AC-driven surface discharge PDP and schematically shows the structure of discharge cells, which are the units for causing discharge. A PDP 1*x* shown in FIG. 10 is composed of a front panel 2 and a back panel 9 assembled together. The front panel 2 includes a glass substrate 3, a plurality of display electrode pairs 6 (each pair is made up of a scan electrode 5 and a sustain electrode 4) that are disposed on one main surface of the glass substrate 3, a dielectric layer 7 and a protective layer 8 that are laid in the stated order to cover the display electrode pairs 6. Each scan electrode 5 (sustain electrode 4) is composed of a transparent electrode 51 (41) and a bus line 52 (42).

The dielectric layer 7 is made of low-melting glass having a softening point temperature on the order of 550° C. to 600° C. The dielectric layer 7 performs a current limiting function that is specific to an AC-PDP.

The protective layer 8 is made of magnesium oxide (MgO), for example. The protective layer 8 protects the dielectric layer 7 as well as the display electrode pairs 6 from ion bombardment at the time of plasma discharge. In addition, the protective layer 8 effectively emits secondary electrons thereby to reduce the firing voltage. Normally, the protective layer 8 is manufactured by vacuum vapor deposition (Patent Documents 7 and 8) or printing (Patent Document 9).

The back panel 9, on the other hand, includes a glass substrate 10 and a plurality of data (address) electrodes 11 disposed on a main surface of the glass substrate 10. The plurality of data electrodes 11 are used to address image data and disposed in parallel to one another and extend in a direction orthogonal to the display electrode pairs 6 disposed on the front panel 2. The back panel 9 additionally includes a dielectric layer 12 made of low-melting glass and laid to cover the data electrodes 11 and the glass substrate 10 at least partially. In addition, barrier ribs 13 made of low-melting glass are disposed on the dielectric layer 12 to partition a discharge space 15 into a plurality of discharge cells (not illustrated). More specifically, the barrier ribs 13 are of a predetermined height and composed of portions 1231 and 1232 coupled to form a grid pattern at locations coinciding with boundaries between the adjacent discharge cells. Phosphor layers 14 of the respective colors of R, G, and B (phosphor layers 14R, 14G, and 14B) are formed one each between each two adjacent barrier ribs 13, by applying and burning phosphor inks of the respective colors. Each phosphor layer 14 is so disposed to cover the side surfaces of the adjacent barrier ribs 13 and the surface of the dielectric layer 12 exposed between the barrier ribs 13.

The front and back panels 2 and 9 are placed relatively to each other in a parallel spaced arrangement, such that the display electrode pairs 6 are orthogonal to the data electrodes 11. While this positional relationship is retained, the panels 2 and 9 are sealed together around their edges. The space enclosed therein is filled with a rare gas as a discharge gas, at a pressure of about several tens of kilopascals. Examples of the rare gas include a rare gas mixture such as xenon-neon or xenon-helium. This concludes the description of how the PDP 1*x* is structured.

It is generally noted that the discharge characteristics of a PDP largely depend on the property of a protective layer provided. Various studies have been made in order to improve the discharge characteristics. One of the problems receiving the greatest attention is a problem of discharge delay.

The term "discharge delay" refers to a phenomenon in which discharge occurs with a delay from the leading edge of a pulse when a PDP is driven at high speed by applying narrow pulses. As the discharge delay increases, there is a smaller chance that the discharge completes within the duration corresponding to the pulse width. In such a case, some of the discharge cells may not be addressed as intended, which results in lighting failure.

Several attempts have been made to solve the problem of discharge delay. In one attempt, MgO is doped with such elements as Fe, Cr, and V or alternatively added with Si and Al. By the presence of those dopants, the discharge characteristics of the protective layer improve (Patent Documents 1, 2, 4, and 5). In another attempt, an MgO film is formed directly on a dielectric layer or by a thin-film method, and single-crystal particles containing MgO particles formed by a vapor-phase oxidation process are disposed in a layer on the MgO thin-film. With this arrangement, the discharge characteristics of the protective layer surface improves (Patent Document 3). The latter attempt is said to provide a certain level of improvement on the discharge delay at low temperatures.

Patent Document 1: JP Patent Application Publication No. 08-236028;

Patent Document 2: JP Patent Application Publication No. 10-334809;

Patent Document 3: JP Patent Application Publication No. 2006-054158;

Patent Document 4: JP Patent Application Publication No. 2004-134407;

Patent Document 5: JP Patent Application Publication No. 2004-273452;

Patent Document 6: JP Patent Application Publication No. 2006-147417;

Patent Document 7: JP Patent Application Publication No. 05-234519;

Patent Document 8: JP Patent Application Publication No. 08-287833;

Patent Document 9: JP Patent Application Publication No. 07-296718;

Patent Document 10: JP Patent Application Publication No. 10-125237

Non-Patent Document 1: Chem. Phys. Vol. 90, No. 2, 807, by J. F. Boas, J. (1988).

DISCLOSURE OF THE INVENTION

Problems the Invention is Attempting to Solve

Unfortunately, however, any prior art including those listed above has not yet provided an effective solution to the problem of discharge delay.

Patent Document 3 discloses the following regarding the spectrum of electron excited emission (cathodoluminescence, hereinafter simply "CL") of MgO particles formed by vapor-phase oxidation. That is, the value of an emission peak in the wavelength region from 200 nm to 300 nm, exclusive of 300 nm (hereinafter, this wavelength region is referred to as "short-wavelength region") increases with the size of MgO particles. The present inventors have found that the size of each emission peak appearing in a wavelength region from 300 nm to 550 nm, exclusive of 550 nm (hereinafter, this wavelength region is referred to as "medium-wavelength region") and in a wavelength region from 650 nm to 900 nm, exclusive of 900 nm (hereinafter, this wavelength region is referred to as "long-wavelength region") is in correlation with the discharge delay of PDP as well as with the temperature dependence of the discharge delay.

It should be noted, in addition, that MgO crystal particles formed by vapor phase oxidation vary largely in size and many fine particles are present to surround relatively large particles. The presence of such fine particles along with particles of an adequate size leads to that the effect of suppressing discharge delay is reduced and that the risk of scattering of visible light is increased. The latter risk incurs another risk that the transmittance of the PDP panel, which is required to ensure an adequate level of image display performance, is heavily reduced. In order to eliminate or reduce such risks, an additional step of classifying the MgO particles in size is required (Patent Document 6). However, the addition of such a step is not desirable because it leads to an increase in the number of steps and also to increase in the manufacturing cost resulting from wasted MgO material.

As described above, any prior art has not yet provided a practical solution to achieve both the "reduction of discharge delay" and "reduction of the temperature dependence of the discharge delay (especially of discharge delay at low temperatures)." The problems described above may be more notable in the case where fine-cell pitch panels, such as full high-definition TVs, are driven at high-speed. Thus, it is strongly desired that a solution to the above problems is promptly provided.

The present invention is made in view of the above problems and aims to improve discharge characteristics of a protective layer in order to provide a PDP that achieves high image display performance even if the PDP is of a fine-cell structure. The present invention also aims to provide a manufacturing method of such a PDP.

Means for Solving the Problems

In order to achieve the above aim, the present invention provides a plasma display panel including: a first substrate; a plurality of electrodes, a dielectric layer, and a protective layer that are laid on the first substrate in the stated order; and a second substrate opposed to the first substrate, with the protective layer facing toward a discharge space. The protective layer includes crystal particles disposed in a layer that is exposed to the discharge space at least partially. The crystal particles include MgO particles satisfying a condition that a ratio of a/b is equal to 1.2 or higher, where "a" denotes a spectrum integral value of a portion of a cathodoluminescence spectrum corresponding to a wavelength region of 650 nm to 900 nm, exclusive of 900 nm, and "b" denotes a spectrum integral value of a portion of the cathodoluminescence spectrum corresponding to a wavelength region of 300 nm to 550 nm, exclusive of 550 nm.

Here, it has been determined that the following is more and more preferable in the stated order: the a/b ratio is equal to "2.3" or higher, equal to "7" or higher, and equal to "23" or higher.

Here, the MgO particles of the present invention may further satisfy a condition that a ratio of a/c is equal to "0.9" or higher. Here, within a portion of the cathodoluminescence spectrum corresponding to a wavelength region of 200 nm to 900 nm exclusive of 900 nm, "a" denotes the spectrum integral value of the portion of the cathodoluminescence spectrum corresponding to the wavelength region of 650 nm to 900 nm, exclusive of 900 nm, and "c" denotes a spectrum integral value of a portion of the cathodoluminescence spectrum corresponding to a wavelength region of 200 nm to 650 nm, exclusive of 650 nm.

Here, it has been determined that the following is more and more preferable in the stated order: the a/c ratio is equal to "1.9" or higher, equal to "4.5" or higher, and equal to "9.1" or higher.

In another aspect, the present invention provides a plasma display panel having: a first substrate; a plurality of electrodes, a dielectric layer, and a protective layer that are laid on the first substrate in the stated order; and a second substrate opposed to the first substrate, with the protective layer facing toward a discharge space. The protective layer includes crystal particles disposed in a layer that is exposed to the discharge space at least partially. The crystal particles include MgO particles satisfying a condition that a ratio of d/e is equal to "0.8" or higher, where "d" denotes a peak value in a portion of a cathodoluminescence spectrum corresponding to a wavelength region of 650 nm to 900 nm, exclusive of 900 nm, and "e" denotes a peak value in a portion of the cathodoluminescence spectrum corresponding to a wavelength region of 300 nm to 550 nm, exclusive of 550 nm.

Here, it has been determined that the following is more and more preferable in the stated order: the d/e ratio is equal to "1.7" or higher, equal to "16" or higher, and equal to "24" or higher.

Here, the MgO particles of the present invention may further satisfy a condition that a ratio of d/f is equal to "0.8" or higher. Here, within a portion of the cathodoluminescence spectrum corresponding to a wavelength region of 200 nm to 900 nm exclusive of 900 nm, "d" denotes the peak value in the portion of the cathodoluminescence spectrum corresponding to the wavelength region of 650 nm to 900 nm, exclusive of 900 nm, and "f" denotes a peak value in a portion of the cathodoluminescence spectrum corresponding to a wavelength region of 200 nm to 650 nm, exclusive of 650 nm.

Here, it has been determined that the following is more and more preferable in the stated order: the d/f ratio equal to "1.7" or higher, equal to "5" or higher, and equal to "12" or higher.

Here, the protective layer may include an MgO film and the crystal particle layer that are laid in the stated order.

Here, the protective layer may include an MgO film and the crystal particle layer that are laid in the stated order, and the MgO particles of the crystal particle layer may include MgO particles that are partially embedded in the MgO film.

Alternatively, the protective layer may be composed of the crystal particle layer disposed directly on the dielectric layer.

Effects of the Invention

With the above-stated configuration, the PDP according to the present invention has a protective layer made of such MgO particles satisfying the condition that the ratio of spectrum integral values of long- to medium-wavelength regions of a CL emission spectrum is equal to "1.2" or higher. It has been determined by experiment that provision of such a protective layer achieves to suppress discharge delay of the PDP and temperature dependence of the discharge delay. Thus, it is expected that the discharge characteristics of the protective layer (discharge delay and the temperature dependence of the discharge delay) improve. Consequently, the image display performance of the PDP improves.

Alternatively to the above-specified ratio, it has been determined by experiment that a similar effect is achieved by such MgO particles satisfying the condition that the ratio of the peak values of the long- to medium-wavelength regions of a CL emission spectrum is equal to "0.8" or higher. It has also been determined that the spectrum integral value or the peak value of the long-wavelength region may be compared to the respective values of a wavelength region from 200 nm to 900 nm, both inclusive, instead of the medium-wavelength region. If the ratio of the spectrum integral values is equal to "0.9" or higher, a similar effect as noted above is still achieved. In addition, a similar effect is still achieved if the ratio of the peak values is equal to "0.8" or higher.

BEST MODE FOR CARRYING OUT THE INVENTION

The following describes an embodiment and examples of the present invention. It should be naturally appreciated, however, that the present invention is not limited to the specific embodiment and examples. Various modifications may be made and practiced without departing from the scope of the present invention.

Embodiment 1

(Exemplary PDP Structure)

FIG. 1 is a schematic cross sectional view of a PDP 1 according to Embodiment 1 of the present invention, taken along the x-z plane. The PDP 1 is basically identical in structure to the conventional PDP (FIG. 10), except for the configurations of the protective layer and relevant parts.

According to Embodiment 1, the PDP 1 is a 42-inch AC-type NTSC plasma display panel. It should be appreciated, however, that the preset invention is applicable to other types of PDPs including XGA and SXGA PDPs. Examples of high-definition PDPs capable of display at a resolution comparable to HD (High Definition) or higher include the following: a PDP having a 37-inch panel with 1024×720 pixels; a PDP having a 42-inch panel with 1024×768 pixels, and a PDP having a 50-inch panel with 1366×768 pixels. Examples of panels having a resolution comparable to HD or higher includes a full HD panel with 1920×1080 pixels.

As illustrated in FIG. 1, the PDP 1 is composed generally of the front panel 2 and the back panel 9 that are disposed in spaced face-to-face relation.

The front panel 2 has the front glass substrate 3. The plurality display electrode pairs 6 (each made up of a scan electrode 5 and a sustain electrode 4) are disposed on one main surface of the front glass substrate 3. The electrode pairs 6 are disposed in a manner to leave a discharge gap of a predetermined width (75 μm) between the display electrodes of each pair. Each display electrode pair 6 is made of transparent electrodes 51 and 41 and the bus line 52 and 42 laid on the transparent electrode 51 and 41, respectively. Each transparent electrode is made of a strip of a transparent conductive material (0.1 μm in thickness and 150 μm in width), such as ITO, ZnO, or $SnO_2$. Each bus line (7 μm in thickness and 95 μm in width) is made of an Ag thick-film (2 μm to 10 μm in thickness), an Al thin-film (0.1 μm to 1 μm in thickness), or a laminated thin-film of Cr/Cu/Cr (0.1 μm to 1 μm in thickness), for example. The bus lines 52 and 42 reduce the sheet resistance of the transparent electrodes 51 and 41.

The term "thick-film" used herein refers to a film formed by any of various types of thick film processing according to which a thick-film is formed by applying and burning a paste or the like containing a conductive material. The term "thin-film" used herein refers to a film formed by any of various types of thin-film processing that employs a vacuum process. Examples of thin-film processing include sputtering, ion plating, and electron beam deposition.

The main surface of the front glass substrate 3 on which the display electrode pairs 6 are disposed is entirely coated with the dielectric layer 7 (35 μm in thickness) formed by screen printing, for example. The dielectric layer 7 is made of low-melting glass predominantly composed of lead oxide (PbO), bismuth oxide ($Bi_2O_3$), or phosphorus oxide ($PO_4$).

The dielectric layer 7 performs a current limiting function that is specific to an AC-PDP, which is a factor that extends the lifetime of AC-PDP as compared with DC-PDPs.

The protective layer 8 is disposed on the surface of the dielectric layer 7. The protective layer 8, which is one feature of Embodiment 1, is composed of an MgO film layer 81 and an MgO particle layer 82. The MgO film layer 81 is formed by sputtering, ion plating, vapor deposition, or the like. The protective layer 8 protects the dielectric layer 7 from ion bombardment expected to occur at the time of discharge and reduces the firing voltage. To achieve this, the protective layer 8 is made of a material having a high sputtering resistance and a high secondary electron emission coefficient γ. For the sake of clarity, the figures show MgO particles 16 constituting the MgO particle layer 82 relatively larger than the actual scale. The protective layer 8 is also required to be optically transparent and have high electrical insulation.

The back glass substrate 10 of the back panel 9 has the plurality of data electrodes 11 disposed in a strip pattern on one main surface thereof. More specifically, the data electrodes 11 are disposed to extend in the X direction and parallel with one another in the y direction at a regular interval (360 μm). Each data electrode 11 measures 100 μm in width and is made of an Ag thick-film (2 μm to 10 μm in thickness), an Al thin-film (0.1 μm to 1 μm in thickens), or a laminated thin-film of Cr/Cu/Cr thin-film (0.1 μm to 1 μm in thickness), for example. The dielectric layer 12 measures 30 μm in thickness and is disposed to coat the entire surface of the back glass substrate 10 in a manner to sandwich the data electrodes 11 therebetween.

The barrier ribs 13 (about 110 μm in height and 40 μm in width) are disposed in a grid-like pattern on the dielectric layer 12 at locations coinciding with the gaps between the adjacent data electrodes 11. By virtue of the barrier ribs 13 that partition the adjacent discharge cells from one another, erroneous discharge and optical crosstalk are prevented. For enabling color display, the phosphor layers 14 of the respective colors of red (R), green (G), and blue (B) are each disposed on the dielectric layer 19 between two adjacent barrier ribs 13 in a manner to cover the entire bottom surface (i.e., the dielectric layer 19) and part of the side walls (i.e., the barrier ribs 13). Note that provision of the dielectric layer 12 is optional and the data electrodes 11 may be coated directly with the phosphor layers 14.

The front panel 2 and the back panel 9 are placed in spaced face-to-face relation in a manner that the data electrodes 11 and the display electrode pairs 6 are longitudinally perpendicular to each other. With this positional relationship, the panels 2 and 9 are sealed together along their peripheral edges. The space present between the panels 2 and 9 is filled with a discharge gas composed of an inert gas containing, for example, He, Xe, and Ne at a predetermined pressure.

A space present between each adjacent pair of the barrier ribs 13 is the discharge space 15. A plurality of cells (also referred to as "sub-pixels") are formed at positions corresponding to where the display electrode pairs 6 crosses the data electrodes 11 across the discharge space 15. The cell pitch is 675 μm in x direction and 300 μm in y direction. Three adjacent cells each corresponding to a different one of RGB constitute one pixel (675 μm×900 μm).

As illustrated in FIG. 2, the scan electrodes 5, the sustain electrodes 4, and the data electrodes 11 are each connected to a corresponding one of a scan electrode driver 111, a sustain electrode driver 112, and a data electrode driver 113 that are provided outside the panel as a driving circuit.

(Examples of PDP Driving)

The PDP 1 having the above-stated structure is driven with a known driving circuit (not illustrated) including the drivers 111-113 in the following manner. First, AC voltage of tens to hundreds of kHz is applied across the display electrode pairs 6 to generate a discharge in intended discharge cells. As a result, the excited Xe atoms emit ultraviolet radiation and the phosphor layers 14 emit visible light under excitation by the ultraviolet radiation.

A so-called intra-field time division grayscale display method is one PDP deriving method. According to the method, one field is divided into a plurality of subfields (SF) and each subfield is further divided into a plurality of periods. More specifically, each subfield is composed of the following four periods: (1) an initialization period for resetting or initializing all the display cells to an initial state; (2) an address period for selectively addressing the discharge cells to place the respective discharge cells into a state corresponding to image data input; (3) a sustain period for causing the addressed discharge cells to emit light, and (4) an erase period for erasing wall charges accumulated as a result of the sustain discharge.

In the respective subfields, the following is performed. In the initialization period, wall charges remaining across the entire display screen are initialized (reset). In the subsequent address period, an address discharge is caused exclusively in selected ones of the discharge cells to accumulate wall charges therein. In the sustain period that follows, an AC voltage (sustain voltage) is applied concurrently to all the discharge cells to sustain the discharge for a fixed time period to emit light. As a result, an image is displayed.

FIG. 3 illustrates one example of driving waveforms applied in the m-th subfield of one field. As shown in FIG. 3, each subfield is composed of the initialization period, the address period, the sustain period, and the erase period.

The initialization period is provided for erasing wall charges across the entire display area (by causing an initialization discharge). As a result, the influence of previously illuminated cells (influence of previously accumulated wall charges) is eliminated. In the example shown in FIG. 3, a higher voltage is applied to the scan electrodes 5 than the voltage applied to the data and sustain electrodes 11 and 4 to cause gaseous discharge in the cells. The electrical charges are generated through the gaseous discharge accumulate on the walls of each cell, so that the potential difference between the data electrodes 11, the scan electrode 5, and the sustain electrode 4 is cancelled out. As a result, negative electric charges are accumulated as wall charges on part of the surface of the protective layer 8 relatively close to the scan electrode 5. On the other hand, positive electric charges are accumulated as wall charges on part of the surface of the phosphor layers 14 relatively close to the data electrodes 11 as well as on part of the surface of the protective layer 8 relatively close to the sustain electrode 4. The negative and positive wall charges of a predetermined magnitude develop a potential across the scan-data electrodes 5 and 11 and across the scan-sustain electrodes 5 and 4.

The address period is provided to address the cells selected according to an image signal for the respective subfields (i.e., setting the ON/OFF states of the respective cells). In order to turn ON a cell, a lower voltage is applied to the scan electrode 5 than to both the data electrode 11 and the sustain electrode 4. That is, a voltage is applied between the scan-data electrodes 5 and 11 in the same polarity as the wall potential. At the same time, a data pulse is applied between the scan-sustain electrodes 5 and 4 in the same polarity as the potential created by the wall charges. As a result, an address discharge (write discharge) is generated. Because of the address discharge, negative electric charges are accumulated on part of the surface of the phosphor layer 14 and part of the surface of the protective layer 8 relatively close to the sustain electrode 4. On the other hand, positive electric charges are accumulated on part of the surface of the protective layer 8 relatively close to the scan electrode 5. The negative and positive charges develop a predetermined potential across the sustain-scan electrodes 4 and 5.

The sustain period is provided for sustaining the discharge by extending the duration of the ON state caused by the address discharge so as to maintain the individual cells at the respective luminance levels corresponding to intended gradation levels. In the sustain period, sustain pulses (for example, rectangular-wave voltages of about 200 V) are applied to each electrode of the display electrode pair (i.e., the scan electrode 5 and the sustain electrode 4) in a manner that the respective pulses are out of phase from each other. As a result, in each cell set to be ON, a pulse discharge is produced each time the voltage polarity reverses.

With the sustain discharge, the excited Xe atoms present in the discharge space emit the resonance line at 147 nm and the excited Xe molecules emit a molecular beam mainly at 173 nm. Irradiated with the resonance line and the molecular beam, the phosphor layers 14 emit visible light to present a display image. The different colors and grayscale levels of a display image are achieved by combinations of the respective colors of R, G, and B in the individual subfields. Each OFF-state cell having no wall charges accumulated on the protective layer 8 stays black (non-illuminated) because no sustain discharge occurs therein.

In the erase period, a decreasing erase pulse is applied to the scan electrodes 5 to erase the wall charges.

(Regarding Protective Layer 8)

One feature of the PDP 1 according to Embodiment 1 is found in the configuration of the protective layer 8. According to Embodiment 1, the protective layer 8 is composed of the MgO film layer 81 disposed on the dielectric layer 7 and the MgO particles 16 disposed in a layer to constitute the MgO particle layer 82 on the MgO film 81. The MgO film layer 81 measures from 0.3 μm to 1 μm in thickness.

The MgO film layer 81 is a thin-film formed by sputtering, ion plating, or electron beam deposition, for example. The MgO film layer 81 serves to accumulate a sufficient amount of wall charges during PDP operation. The MgO particles 16 are formed by burning an MgO precursor and relatively uniform in size in a range of 300 nm to 4 μm. The MgO particle layer 82 is formed by coagulating the MgO particles 16 that are spread out flatwise. Note that the average particle size is determined based on the diameters of the particles displayed on SEM images.

It is sufficient that the MgO particle layer 82 is disposed to cover at least part of the protective layer 8 that would otherwise be exposed to the discharge space. In addition, it is desirable that the total area covered by the individual MgO particles scattered falls in a range of 1% to 30% of the total area of the protective layer 8 exposed to the discharge space (in this case, the area of the MgO film layer 81 facing into the discharge space). That is, it is not necessary that the MgO particles 16 are disposed to cover the entire surface of the MgO film layer 81. Rather, it is preferable that the MgO particles 16 are scattered on the MgO film layer 81 like a plurality of separate islands. In other words, it is preferable that the area of the MgO particle layer 82 exposed to the discharge space 15 is smaller than the area of the protective layer 8 exposed to the discharge space.

The following provides more detailed explanation. As described above, the MgO film layer 81 is primarily for accumulating and maintaining wall charges and keeping, during PDP operation, voltage necessary for causing sustain discharge across the display electrodes 4 and 5. On the other hand, the MgO particles 16 are provided specifically for improving electron emission into the discharge space 15 during PDP operation. For the purposes of description, it is assumed that the MgO particles 16 are densely disposed to cover the entire surface of the MgO film layer 81. Such a configuration ensures that electrons are actively emitted into the discharge space 15. Unfortunately, however, the electron emission is rather too excessive, so that not enough electrons remain for causing a sustain discharge. This leads to a risk that an appropriate sustain discharge cannot be caused. Thus, it is necessary to effectively eliminate such a risk and ensure both the voltage sustaining capability of the MgO film layer 81 and the electron emission capability of the MgO particles. To this end, it is preferable that some part of the surface of the MgO film layer 81 is directly exposed to the discharge space 15. This is why it is preferable that the MgO particles are sparsely scattered on the MgO film layer 81. In order to achieve the above arrangement of the MgO particles, the MgO particles may be disposed in form of secondary particles each composed of a plurality of particles. Alternatively, the MgO film layer 81 may be patterned on the protective layer 8 using a known inkjet printing. Note that the term "islands" used herein broadly refers to any deposition of the MgO particle layer 82 in a manner to leave at least part of the MgO film layer 81 exposed to the discharge space.

Note that the "total area covered by the individual MgO particles scattered" refers to the areas of the MgO film layer 81 and of the dielectric layer 7 that are hidden below the MgO particles when the protective layer 8 is seen from a direction perpendicular to the plane of the protective layer 8. In other words, the total area of the MgO particle layer 82 exposed to the discharge space 15 is smaller than the total area of the front panel 2 exposed to the discharge space 15.

Note that the MgO particles according to the present invention are different in geometric shape from conventional particles formed by burning a precursor. That is, while a conventional MgO particle is in a flattened planar shape having one side longer than another, an MgO particle of the present invention is substantially hexahedral or octahedral having sides mostly falling within a predetermined length range. In the case of a hexahedral particle, it is preferable that the particle is a regular hexahedral particle. Yet, in view of in-process discrepancies, it is sufficient that a ratio between the longest and shortest sides of a hexahedral particle falls within a range of 1:1 to 2:1. In addition, it is not necessary that the hexahedral or octahedral particles have fine or solid edges and vertexes.

The MgO particles 16 have high energy levels in the energy band (i.e., energy levels immediately below the conduction band), so that the electron emission property improves. As a consequence, the presence of MgO particles 16 are expected to solve both the problems of discharge delay and temperature dependence of discharge delay.

As clarified above, the MgO particles 16 have the properties noted above, it is expected to achieve significant effects as a material of the protective layer 8. In addition, since the MgO particles 16 are prepared by burning an MgO precursor, the particle size is more uniform as compared with MgO particles prepared by conventional vapor-phase oxidation (as in JP Patent Application Publication No. 2006-147417), which will be described later. Thus, the MgO particles 16 also achieve uniform discharge characteristics.

According to the present invention, by virtue of the protective layer 8 as described above, the PDP is expected to be smaller in discharge delay upon application of the drive voltage. In addition, it is also expected that the temperature dependence of the discharge delay improves, so that screen flickering is prevented. The above improvement is expected even if the partial pressure of Xe gas in the discharge gas is high. As a consequence, the PDP is expected to achieve high quality image performance.

The properties of the MgO particles 16 are defined in terms of the results of CL measurements. A first definition of the MgO properties 16 is as follows:

"Let a denote the spectrum integral value of the long-wavelength region of a CL spectrum, and let b denote the spectrum integral value of the medium-wavelength region of the CL spectrum, the ratio a/b is equal to "1.2" or higher."

FIG. 4 is a graph showing a ridge appearing in a portion of CL spectrum corresponding to the long-wavelength region. The ridge shown in FIG. 4 has substantially a single peak, and this feature of the waveform is not observed in a CL spectrum of MgO particles formed by a conventionally known method, such as vapor-phase oxidization. The present inventors have confirmed by experiment that the presence or absence and the size of a ridge in the long-wavelength region provides an indication of the extent to which the discharge delay and the temperature dependence of the discharge delay are suppressed.

Note that the experimental data shown in FIG. 4 was obtained by measuring the MgO particles before formed into a protective layer of a PDP (i.e., in powder phase).

FIG. 11 is a view schematically showing a spectrophotometric measurement method carried out with a high-sensitivity spectrophotometer system. The data shown in FIG. 4 was measured in the following manner. As illustrated in FIG. 11, a sample placed in a vacuum chamber is irradiated with an electron beam (EB) under the following conditions: incident energy=3 keV, beam current=3.9 μA, and incident angle=45°. The light from the sample is guided via an optical system such as a lens and a fiber, to the high-sensitivity spectrophotometer system (IMUC7500 manufactured by OTSUKA ELECTRONICS CO., LTD., in this case) having a spectroscope to conduct spectral observations.

Note that the measurement system used herein performed wavelength calibration for sensitivity correction of the spectroscope.

In light of the above, by virtue of the MgO particle layer 82 containing the MgO particles 16 and disposed on the surface of the protective layer 8 facing toward the discharge space 15, the PDP 1 of Embodiment 1 effectively suppresses "discharge delay" and "temperature dependence of the discharge delay", which are the problems the present invention aims at.

Note that the CL measurement is a measurement method according to which a sample is irradiated with an electron beam to detect an emission spectrum which is observed in the process of electron energy relaxation. Through the CL measurement, the protective layer is analyzed to obtain detailed information thereof (for example, whether or not any oxygen defect is present).

In addition, the "spectrum integral value" is an integral value of the emission distribution within a predetermined wavelength region.

(Protective Layer Properties Determined from CL Measurements)

The MgO particles 16 of the PDP according to the present invention have the properties defined by the first definition that is supported by the result of CL measurements. In addition, another definition applies to the properties of the MgO particles 16 as follows:

"Within a portion of a CL spectrum corresponding to a wavelength region of 200 nm to 900 nm exclusive of 900 nm, let a denote the spectrum integral value in the long-wavelength region, and let c denote the spectrum integral value in a wavelength region from 200 nm to 650 nm, exclusive of 650 nm, the ratio a/c is equal to "0.9" or higher."

The following describes the principles on which on which the above definition is based.

Generally, an MgO emission spectrum observed in CL measurement has an emission peak in the medium-wavelength region in addition to an emission peak in the short-wavelength region. As disclosed for example in Patent Document 3, a conventionally known vapor-phase oxidation process is a synthesis method carried out as follows. First, Mg (magnesium metal) is placed in a bath filled with an inert gas. Next, the Mg in the bath is heated to high temperatures, while supplying a small amount of oxygen gas. As a result, the Mg is directly oxidized into MgO particles (MgO powder). This method has a setback that MgO may not absorb a sufficient amount of oxygen, which leads to the presence of oxygen defects in the resulting MgO particles (MgO powder).

It is generally considered that the emission peak in the medium-wavelength region is caused by oxygen defects (See Non-Patent Document 1). Thus, the MgO particles prepared by vapor-phase oxidation show an apparent peak in the medium-wavelength region. Such a peak is considered to be a sign of a longer discharge delay and a heavier temperature dependence of the discharge delay. If a large number of energy levels that would result in the formation of a ridge of the wave in the medium-wavelength region are in the MgO bandgap, electron transitions are expected to take place relatively frequently and thus the energy relaxation takes place relatively easily. As a result, the excited state of electrons cannot be trapped long at that energy level. As a result, it is not likely that a sufficient number of electrons are at energy levels in the vicinity of the conduction band. Consequently, the electron emission coefficient is reduced, which leads to problems of discharge delay and of temperature dependence of discharge delay.

On the other hand, if a large peak is observed in the long-wavelength region of a CL spectrum, it is indicated that the MgO has high energy levels (i.e., energy levels immediately below the conduction band) corresponding to the energy band. The presence of high energy levels serves as a factor that improves the electron emission coefficient, so that it is expected to solve both the problems "discharge delay" and "temperature dependence of the discharge delay".

The CL measurement was conducted on the MgO particles 16 of Embodiment 1. As stated above, the MgO particles 16 are obtained by burning an MgO precursor. The resulting CL spectrum shows that the ratio of spectrum integral values of long- to medium-wavelength regions is equal to "1.2" or higher (See FIG. 4). In addition, the CL spectrum has a ridge of a significant value in the long wavelength region, as compared with any ridge appearing in the medium-wavelength region. The size of the ridge appearing in the long-wavelength region is said to be specific to the present invention and provides an indication of the extent of the effect of suppressing discharge delay and the temperature dependence of the discharge delay.

Since the ratio is equal to "1.2" or higher, the MgO particles 16 of the present invention has a number of high energy levels in the energy band (i.e., energy levels immediately below the conduction band). This allows the PDP 1 to cause emission of initial electrons relatively easily as compared with conventionally prevalent PDPs. This leads to an excellent effect of suppressing discharge delay and suppressing temperature dependence of the discharge delay during PDP operation. Thus, it is expected that the discharge characteristics of the protective layer (discharge delay and the temperature dependence of the discharge delay) improve, and consequently the image display performance of the PDP 1 improves.

As described above, the protective layer of Embodiment 1 shows a CL spectrum having the waveform satisfying the first definition noted above. In addition, another definition applies to the properties of the protective layer of Embodiment 1.

That is, the properties of MgO particles contained in the MgO particles 16 are defined by a second definition as follows:

"Let d denote the peak value in the long-wavelength region of a CL spectrum, and let e denote the peak value in the medium-wavelength region of the CL spectrum, the ratio d/e is equal to "0.8" or higher."

In addition, the following definition also applies.

"Within a portion of a CL spectrum corresponding to a wavelength region of 200 nm to 900 nm exclusive of 900 nm, let d denote the peak value in the long-wavelength region, and let f denote the peak value in a wavelength region from 200 nm to 650 nm, exclusive of 650 nm, the ratio d/f is equal to "0.8" or higher."

Note that the "peak value" refers to the maximum intensity value of an emission spectrum observed within a predetermined wavelength region.

Practically, the upper limits of the spectrum integral value ratio and of the peak value ratio are both 500 times or so, in view of the measurement capability of the CL measurement device (i.e., in view of the saturation of measurable emission spectra).

(PDP Manufacturing Method)

The following describes an exemplary manufacturing method of the PDP 1.

(Steps of Manufacturing Front Panel)

First of all, a front substrate made of soda lime glass having a thickness of about 2.6 mm is prepared. On one main surface of the glass substrate, display electrodes are disposed. In the following description, the display electrodes are formed by printing. Yet, it is applicable to employ any other methods including a dye coat method and a blade coat method.

To form the display electrodes, first, a transparent electrode material, such as ITO, $SnO_2$, or ZnO is applied onto the front glass substrate in a predetermined pattern to have the final thickness of about 100 nm. The applied pattern of the transparent material is then dried, so that transparent electrodes are formed.

A photosensitive paste is prepared by blending Ag powder and an organic vehicle with a photosensitive resin (photodegradable resin). The photosensitive paste is applied to the transparent electrodes. Then, a mask having a pattern corresponding to display electrodes to be formed is placed to cover the entire surface of the glass substrate on which the transparent electrodes are formed. In a developing process, the photosensitive resin is exposed to light through the mask. In a subsequent step, the resulting pattern of the photosensitive paste is burned at burning temperatures in a range of about 590° C. to 600° C. Through the above steps, bus lines are formed on the transparent electrodes. Conventionally, the width of a finest possible pattern with screen printing is up to 100 μm. In contrast, with the photo-mask method described above, the fine bus lines each having a width of 30 μm or so is possible. The bus lines may be made of any other metal materials than Ag, and examples of such other materials include Pt, Au, Al, Ni, Cr, tin oxide and indium oxide. In addition, instead of the above-mentioned method, the bus lines may be mad by first fabricating a layer of an electrode material using vapor deposition or sputtering, and then by etching the electrode material layer.

In a subsequent step, a paste is prepared by mixing dielectric glass powder with an organic binder. The dielectric glass powder may be any of lead oxide, bismuth oxide, and $SiO_2$ glass powder having a softening point falling within a range of 550° C. to 600° C. In addition, the organic binder may be made of butyl carbitol acetate. The mixture paste then is applied to form a layer over the display electrodes. The applied layer is then burned at temperatures of 550° C. to 650° C. Through the above steps, a dielectric layer having a final thickness of 2 μm or less is formed.

(Steps of Forming Protective Layer)

In a subsequent step, the MgO film layer 81 having a predetermined thickness is formed on the surface of the dielectric layer by vapor deposition. The MgO film layer 81 is formed in a similar manner to a conventional MgO layer. The deposition source may be MgO in the form of pellet or powder. In an oxygen atmosphere, the deposition source is heated by using a Pierce-type electron beam gun thereby to form a desired film. The conditions of the film formation, such as the amount of the electron beam current, the partial pressure of oxygen, and the temperature of substrate, may be arbitrarily set because such settings have little effect on the composition of the resulting protective layer. In addition, the MgO film layer 81 may be formed by any other method than the EB method described above. For example, any of various thin-film methods including sputtering and ion plating may be employed.

Subsequently, a solvent containing predetermined MgO particles is applied on the MgO film layer 81, by screen printing or spraying, for example. The solvent is subsequently burned off to be removed. As a result, the MgO particle layer 82 containing the predetermined MgO particles is formed (MgO particle layer forming step).

The predetermined MgO particles contained in the MgO particle layer 82 are obtained in the MgO particle forming step in the following manner, for example. An MgO precursor is evenly heat-treated (burned) at a temperature from 1400° C. to 2000° C., both inclusive. The thus obtained MgO crystals exhibit a CL spectrum satisfying that the ratio a/b is equal to "1.2" or higher, where a denotes the spectrum integral value of the long-wavelength region and b denotes the spectrum integral value of the medium-wavelength region.

In the case where the MgO particles are single crystal particles, fewer defects are expected and thus the above-noted effect is exhibited even more notably.

The MgO precursor may be one or more compounds (any combination of compounds) selected from the following: magnesium alkoxide ($Mg(OR)_2$), magnesium acetylacetone ($Mg(acac)_2$), magnesium hydroxide ($Mg(OH)_2$), magnesium carbonate, magnesium chloride ($MgCl_2$), magnesium sulfate ($MgSO_4$), magnesium nitrate ($Mg(NO_3)_2$), and magnesium oxalate ($Mg\ C_2O_4$) Some of the compounds listed above may be present in the hydrate phase and such hydrates are also selectable.

The one or more MgO compounds selected as the MgO precursor are so adjusted that the purity of MgO to be obtained by burning the precursor would be 99.95% or higher, and optimally 99.98% or higher. Such MgO compounds are desirable to obtain highly crystallized MgO particles for the following reason. By the presence of a certain amount of impurity such as various alkali metals, B, Si, Fe, and Al, undesirable sintering and/or adhesion among the particles are caused during the heat treatment. To avoid the undesirable occurrence, it is preferable to adjust the precursor by, for example, removing impurity compounds in advance.

In addition, it is preferable that the precursor used in the present invention is highly crystallized and has ellipsoidal particles. Further, it is preferable that the BET value of the precursor falls within a range of 5 to 7 or so. The BET value may be measured by the BET method, using gas molecules ($N_2$) having a known adsorption surface area. The specific surface area of fine particles are determined based on the amount of gas molecular adsorbed on the fine particles.

Next, the burning temperature is preferably adjusted to 700° C. or higher, and more preferably to 750° C. or higher, for the following reason. If the burning temperature is below 700° C., sufficient growth of crystal face cannot be expected and thus the resulting MgO may include a number of defects, which adsorb more impurity gas. Yet, if the burning temperature is higher than 2000° C., too much oxygen is removed, which leads to more MgO defects and thus more impurity adsorption. It should be noted that the presence of more defects leads to less emission and more impurity gas adsorption. In view of the above, the burning temperature is preferably 1800° C. or lower.

Suppose that MgO is burned at the temperature within a range of 700° C. to 2000° C. As a result, the following two different types of MgO particles are obtained. One is MgO particles having properties defined by the first definition that reads as follows:

"Let g denote the spectrum integral value of a portion of a CL spectrum corresponding to the wavelength region from 200 nm to 300 nm, exclusive of 300 nm, and let h denote the spectrum integral value of a portion of the CL spectrum corresponding to the wavelength region from 300 nm to 550 nm, exclusive of 550 nm, the ratio g/h is equal to "1" or higher." The other is MgO particles having properties that show a CL spectrum with a significant level of peak value in the long-wavelength region.

The present inventors conducted another experiment to confirm that the burning temperature of 1400° C. or higher increases the percentage of the latter type of MgO particles showing a CL spectrum satisfying that the a/b ratio is equal to "1.2" or higher. In view of the above experiment, the burning temperature of 1400° C. or higher is preferable in order to more reliably obtain MgO particles having properties to satisfy that "the a/b ratio is equal to "1.2" or higher."

Note that MgO particles having properties to satisfy that "the a/b ratio is equal to "1.2" or higher" tend to be smaller in size than MgO particles having properties to satisfy that "the g/h ratio is equal to "1" or higher". Thus, it is possible to separate the above two types MgO particles through a screening (size classification) process.

According to the present invention, the two types of MgO particles all have average particle size falling within a range of 300 nm to 4 μm. The present inventors have confirmed by experiment that the respective types of MgO particles are sufficiently different in average particle sizes and thus it is practical to separate them by the screening process.

The following describes four variations (1)-(4) of a manufacturing method of an MgO precursor and of MgO particles using the MgO precursor.

(1) As a starting material, an aqueous solution of magnesium alkoxide ($Mg(OR)_2$) or magnesium acetylacetone ($Mg(acac)_2$) of 99.95% purity or higher is prepared. Next, a small amount of acid is added to the aqueous solution to cause hydrolysis. As a result, a gel-like precipitate of $Mg(OH)_2$ usable as an MgO precursor is formed. Then, $Mg(OH)_2$ is separated from the aqueous solution and burned in an oxygen atmosphere at a temperature of 700° C. or higher, for dehydration. As a result, MgO particles are obtained.

(2) As a starting material, an aqueous solution of magnesium nitrate ($Mg(NO_3)_2$) of 99.95% purity or higher is prepared. Next, an alkali solution is added to the aqueous solution to cause hydrolysis. As a result, a gel-like precipitate of $Mg(OH)_2$ usable as an MgO precursor is formed. Then, $Mg(OH)_2$ is separated from the aqueous solution and burned in an oxygen atmosphere at a temperature of 700° C. or higher for dehydration. As a result, MgO particles are obtained.

(3) As a starting material, an aqueous solution of magnesium chloride ($MgCl_2$) of 99.95% purity or higher is prepared. Next, an alkali solution is added to the aqueous solution to cause hydrolysis. As a result, a gel-like precipitate of $Mg(OH)_2$ usable as an MgO precursor is formed. Then, $Mg(OH)_2$ is removed from the aqueous solution and burned in an oxygen atmosphere at a temperature of 700° C. or higher for dehydration. As a result, MgO particles are obtained.

(4) MgO particles may be formed from any magnesium compound selected from the following: magnesium alkoxide ($Mg(OH)_2$), magnesium nitrate ($Mg(NO_3)_2$), magnesium chloride ($MgCl_2$), magnesium carbonate ($MgCO_3$), magnesium sulfate ($MgSO_4$), magnesium oxalate ($MgC_2O_4$), and magnesium acetate ($Mg(CH_3COO)_2$). The selected magnesium compound is directly subjected to a temperature of 700° C. or higher to cause thermal decomposition in a thermal equilibrium state. With this method, MgO particles are obtained similarly to the above methods.

The MgO particles obtained through any of the above burning steps mostly have a size falling within a range of 300 nm to 4 μm and fine particles of 300 nm or smaller are contained only little. Thus, the MgO particles are smaller in specific surface area than MgO particles formed by vapor-phase oxidation and thus superior in adsorption resistance. This is considered to be one of the factors improving the electron emission.

Note that MgO particles formed by conventional vapor-phase oxidation vary relatively widely in size. Thus, a screening process is required to select particles of a size falling within a predetermined range in order to ensure uniform discharge characteristics (See for example, JP patent application publication No. 2006-147417). According to the present invention, in contrast, the MgO particles obtained by burning an MgO precursor are more uniform in size than MgO particles obtained in a conventional manner. Since the particle size is relatively uniform, a screening process of removing undesirable fine particles may be omitted, which is advantageous in manufacturing efficiency and cost.

This concludes description of the manufacture of the front panel 2.

(Manufacturing of Back Panel)

First of all, a back glass substrate of soda lime glass having a thickness of about 2.6 mm is prepared. On one main surface of the back glass substrate, a conductive material mainly composed of Ag is applied in strips at a regular space interval to form a plurality of data electrodes 11 each measures about 5 μm in thickness. The data electrodes 11 may be made of any of various metals including Ag, Al, Ni, Pt, Cr, Cu, and Pd. Alternatively, the data electrodes 11 may be made of conductive ceramics, such as metal carbide or metal nitride. Alternatively, the data electrodes may be made of any combination of such materials or may be a laminate of such materials.

In order for the resulting PDP 1 to be in compliance with the NTSC or VGA standards provided for a 40-inch class panel, the gap between adjacent data electrodes needs to be about 0.4 mm or less.

In a subsequent step, a glass paste is applied in a layer of about 20 μm to 30 μm thick to cover the entire surface of the back glass substrate on which the data electrodes are formed. The applied layer is then burned to be formed into a dielectric layer. The glass paste may be of a lead-based or lead-free low-melting glass material or an $SiO_2$ material.

In a subsequent step, the barrier ribs 13 are formed on the dielectric layer 12. More specifically, a paste of a low-melting glass material is applied and formed into a grid pattern using a sand blast method or a photolithography method. The resulting barrier ribs 13 partition the adjacent lows and columns of the discharge cells from one another.

After completion of the barrier ribs 13, phosphor inks each containing one of a phosphor of red (R), green (G) or blue (B) are applied to coat respective portions of the dielectric layer 12 exposed between adjacent barrier ribs 13. The applied phosphor inks are then dried and burned to be formed into the phosphor layers 14.

Examples of chemical compositions of the respective RGB phosphors are given below:

Red Phosphor; $Y_2O_3;Eu^{3+}$

Green Phosphor; $Zn_2SiO_4:Mn$

Blue Phosphor; $BaMgAl_{10}O_{17}:Eu^{2+}$

Preferably, each phosphor material is composed of particles having an average size of 2.0 μm. The phosphor material, ethycellulose, and a solvent (α-terpineol) are put into a server at the respective contents of 50%, 1.0%, and 49% by mass percentage and agitated and mixed using a sand mill. As a result, the phosphor inks of the respective colors are prepared at the viscosity of $15\times10^{-3}$ Pa·s. Each ink is then injected between the barrier ribs 13 using a pomp having a 60 μm-diameter nozzle. While the ink is being injected, the back panel is moved in the longitudinal direction of the barrier ribs 13, so that the phosphor ink is applied into a stripped pattern. The applied phosphor inks are then burned for ten minutes at 500° C. to be formed into the phosphor layers 14.

This concludes description of the manufacturing steps of the back panel 9.

According to the above description, the front glass substrate 3 and the back glass substrate 10 are made of soda lime glass. However, soda lime glass is mentioned as an example and any other materials may be used.

(Final Assembly of PDP)

The front panel 2 and the back panel 9 manufactured through the above steps are sealed together around their peripheral edges using sealing glass. After the sealing, the discharge space is evacuated to a high vacuum ($1.0\times10^{-4}$ Pa or so) and then filled with a discharge gas at the pressure of 66.5 kPa to 101 kPa. As described above, the discharge gas may be a Ne—Xe-based, He—Ne—Xe-based or Ne—Xe—Ar-based gas.

This concludes description of all the manufacturing steps of the PDP 1.

(Performance Evaluation Experiments)

The following describes the performance evaluation experiments conducted on sample PDPs shown in Tables 1 and 2 to compare the utility of PDPs according to Examples of the present invention and of Comparative Examples of a conventional PDP.

For comparison purposes, the samples of Examples and Comparative Examples were prepared under the same manufacturing conditions, except for the following. That is, each sample was prepared with: a different MgO precursor material under different manufacturing conditions (heat treatment conditions); a different type of MgO particles; and a different Xe gas concentration in the discharge gas.

Examples 1-4 are provided with MgO particles that were prepared by burning an MgO precursor and that showed a CL spectrum having a ridge in the long-wavelength region. The MgO particles were then disposed according to the embodiment of the present invention, so that each sample PDP was provided with an MgO particle layer. Comparative Example 4 is similar to Examples 1 and 2 in that the MgO particle layer was composed of MgO particles obtained by burning an MgO precursor. Yet, the MgO particles of Comparative Example 4 were prepared at a lower burning temperature (600° C.) than that of Examples 1 and 2.

Although the MgO films of Examples 2 and 4 were prepared by vacuum deposition, the MgO film may be prepared by another method, such as ion plating or spattering.

(Details of Experiments)

Experiment 1; Evaluation of Discharge Delay

In the manner described below, each sample PDP prepared as above was evaluated for a discharge delay responsive to pulse application.

First of all, an initialization pulse shown in FIG. 3 was applied to an arbitrary pixel of each respective PDP and then data and scan pulses were repeatedly applied to the pixel. The width of each data pulse and scan pulse was set to be 100 μsec, which was longer than the pulse width of 5 μsec normally applied to drive a PDP. Each time a data or scan pulse was applied, the time period taken until occurrence of a discharge (discharge delay time) was repeatedly measured 500 times. Then, the average values of the maximum and minimum delay times were calculated.

The delay times were measured by receiving light emitted from a phosphor responsive to a discharge, with an optical sensor module (H6780-20 manufactured by Hamamatsu Photonics K. K.) and by observing the waveform of the applied pulse and the waveform of the received light signal with a digital oscilloscope (DL9140 manufactured by Yokogawa Electric Cooperation).

Tables 1 and 2 also show the measurement results of "discharge delay" and "temperature dependence of the discharge delay". The measurement results of the discharge delay shown in Tables 1 and 2 are relative values, with the duration of the discharge delay of Comparative Example 1 being taken as unity. A smaller relative value indicates a shorter discharge delay time. It should be noted, in addition, that the values shown in Tables 1 and 2 are values measured when the respective Examples 1-4 and Comparative Examples 1-4 exhibited a sufficient level of effect of suppressing "discharge delay" and "temperature dependence of the discharge delay".

Experiment 2; Evaluation of Temperature Dependence of Discharge Delay

In a similar manner to Experiment 1, each sample PDP of Examples and Comparative Examples was evaluated for discharge delays at different temperatures of −5° C. and 25° C. using a constant temperature bath. Next, a ratio between the discharge delay times observed at −5° C. and at 25° C. was calculated for each sample PDP. Tables 1 and 2 also show the results. A ratio closer to "1" indicates less temperature dependence of the discharge delay.

Experiment 3; Evaluation of Dependence on Number of Sustain Pulses

In a similar manner to Experiment 1, each sample PDP of Examples and Comparative Examples was evaluated for discharge delays under application of a minimum number of sustain pulses. The measurement results of the discharge delays were evaluated relatively to the discharge delays responsive to application of the maximum number of sustain pluses being taken as unity. A smaller ratio indicates a more preferable protective layer having less dependence of discharge delay on the number of sustain pulses.

Experiment 4; Evaluation of Flickering

Each sample PDP was caused to display a white picture and visually inspected for occurrence of screen flickering.

Tables 1 and 2 show the conditions and results of each experiment.

TABLE 1

| | Protective Layer Configuration (Single or Dual Layer) | Protective Layer Formation Method & Purity of Precursor (%) | Burning Temperature | Discharge Delay from Pulse Application Comparative Example 1 Taken as Unity (25° C.) Xe Concentration 15% | Xe Concentration 100% |
|---|---|---|---|---|---|
| Example 1 | Single-Layer; MgO Particle Layer on Dielectric Layer – MgO Particles Having Emission Peak in Long-Wavelength Region of CL Spectrum | Direct Thermal Decomposition of $MgCO_3$ (99.96%) | 1400° C. | 0.2 | 0.23 |
| Example 2 | Dual-Layer; MgO Film Layer on Dielectric Layer + MgO Particle Layer on MgO Film Layer – MgO Film Layer Formed by Vapor Deposition – MgO Particles Having Emission Peak in Long-Wavelength Region of CL Spectrum | Add $Ca(OH)_2$ to Aqueous Solution of $MgCl_2$ to Obtain $Mg(OH)_2$ (99.99%) | 1400° C. | 0.1 | 0.12 |

TABLE 1-continued

| | | | | | |
|---|---|---|---|---|---|
| Example 3 | Single-Layer; MgO Particle Layer on Dielectric Layer – MgO Particle Layer Having Emission Peak in Long-Wavelength Region of CL Spectrum | | 1200° C. | 0.13 | 0.14 |
| Example 4 | Dual-Layer; MgO Film Layer on Dielectric Layer + MgO Particle Layer on MgO Film Layer – MgO Film Layer Formed by Vapor Deposition – MgO Particles Having Emission Peak in Long-Wavelength Region of CL Spectrum | Add $Ca(OH)_2$ to Aqueous Solution of $MgCl_2$ to Obtain $Mg(OH)_2$ (99.99%) | 1200° C. | 0.12 | 0.11 |

| | Temperature Dependence of Discharge Delay (Ratio of Discharge Delay Times at −5° C. to 25° C.) | | Dependence of Discharge Delay on Number of Sustain Pulses *1 | Screen Flickering |
|---|---|---|---|---|
| | Xe Concentration 15% | Xe Concentration 100% | Xe Concentration 15% | Xe Concentration 15% |
| Example 1 | 1.1 | 1.08 | 1.6 | No |
| Example 2 | 1.02 | 1.03 | 1.2 | No |
| Example 3 | 1.0 | 1.07 | 1.6 | No |
| Example 4 | 0.97 | 1.02 | 1.2 | No |

*1: Ratio of Maximum to Minimum Discharge Delays Responsive to Maximum Number of Sustain Pulse

TABLE 2

| | Protective Layer Configuration (Single- or Dual-Layer) | Protective Layer Formation Method & Purity of Precursor (%) | Burning Temperature | Discharge Delay from Pulse Application Comparative Example Taken as Unity (25° C.) | |
|---|---|---|---|---|---|
| | | | | Xe Concentration 15% | Xe Concentration 100% |
| Comparative Example 1 | Single-Layer; MgO Film Formed by Vacuum Deposition | — | — | 1 | 1 |
| Comparative Example 2 | Single-Layer; MgO Particle Layer Composed of Single Crystal Particles Formed by Vapor-Phase Method | Single Crystal MgO Particles Obtained by Vapor-Phase Method | — | 0.56 | 0.65 |
| Comparative Example 3 | Dual-Layer; MgO Film Layer + MgO Particle Layer on MgO Film Layer – MgO Film Layer Formed by Vacuum Deposition – MgO Particle Layer Composed of Single Crystal Particles Formed by Vapor-Phase Method | Single Crystal MgO Particles Obtained by Vapor-Phase Method | — | 0.5 | 0.54 |
| Comparative Example 4 | Dual-Layer; MgO Film Layer on Dielectric Layer + MgO Particle Layer on MgO Film Layer – MgO Film Layer Formed by Vapor Deposition – MgO Particles Layer Having Emission Peak in Long-Wavelength Region of CL Spectrum | Add Na(OH) to $Mg(NO_3)_2$ to Obtain $Mg(OH)_2$ (99.98%) | 600° C. | 0.4 | 0.43 |

| | Temperature Dependence of Discharge Delay (Ratio of Discharge Delay Times at −5° C. to 25° C.) | | Dependence of Discharge Delay on Number of Sustain Pulses *1 | Screen Flickering |
|---|---|---|---|---|
| | Xe Concentration 15% | Xe Concentration 100% | Xe Concentration 15% | Xe Concentration 15% |
| Comparative Example 1 | 5 | 4.9 | 2.57 | Yes |
| Comparative Example 2 | 2.3 | 2.4 | 2.3 | Yes |

TABLE 2-continued

| | | | | |
|---|---|---|---|---|
| Comparative Example 3 | 2.1 | 2.2 | 2 | Yes |
| Comparative Example 4 | 2 | 2.1 | 1.9 | Yes |

*1: Ratio of Maximum to Minimum Discharge Delays Responsive to Maximum Number of Sustain Pulse (Discussion of Experimental Results)

First, the results of Comparative Examples are discussed. The protective layer of Comparative Example 1 was composed solely of a pure MgO film prepared by vacuum deposition and disposed on the dielectric layer. Because of this configuration, the discharge delay was relatively long irrespective of the Xe gas concentration. In addition, the temperature dependence was relatively heavy. Thus, Comparative Example 1 exhibited screen flickering at low temperatures and also exhibited discharge dependence on the number of sustain pulses.

Regarding Comparative Examples 2 and 3, the discharge delay was shorter and the temperature dependence was smaller as compared with Comparative Example 1 but longer and larger as compared with Examples 1-4. Such results are ascribable to the fact that although the protective layer was composed of MgO particles, the MgO particles were prepared by vapor-phase oxidation.

Regarding Comparative Example 4, the protective layer was composed of an MgO thin film prepared by vacuum deposition and a layer of MgO particles disposed on the MgO film layer. Similarly to Examples 1-4, the MgO particles were prepared by heat treating a high-purity MgO precursor. It should be noted, however, that the burning temperature was as low as 600° C. Thus, unlike Examples 1-4, the MgO particles did not go through sufficient crystal growth and thus contained many defects. As a consequence, a portion of a CL spectrum corresponding to the long-wavelength region is smaller, which indicates more adsorption of impurity gas to the MgO particle layer. As a result, although the discharge delay was relatively short, the temperature dependence of the discharge delay was large irrespective of the Xe gas concentration. In addition, occurrence of screen flickering was observed.

Now, the result of Examples are discussed. The protective layer of each of Examples 1-4 was of a single- or dual-layer structure containing a layer of MgO particles of which CL spectrum showed a ridge in the long-wavelength region. Each Example exhibited good electron emission and small temperature dependence. Based on the measurement results, the sample PDPs of Examples are said to have superiority with suppressed "discharge delay" and suppressed "temperature dependence of discharge delay". The favorable results are ascribable to the fact that the MgO particles ware prepared by heat-treating (burning) a high-purity MgO precursor at a temperature of 700° C. or higher. The thus obtained MgO particles contain little crystal defects and high energy levels (i.e., energy levels immediately below the conduction band), which would result in a ridge in the long-wavelength region of a CL spectrum.

Note that the experimental data was obtained on the following conditions: a protective layer of a dual-layer structure composed of the MgO film layer 81 and the MgO particle layer 82 and the Xe gas concentration of 100%.

The present inventors have experimentally confirmed that Examples 1-4 all exhibit similarity in behavior of the discharge delay and the temperature dependence of the discharge delay.

The present inventors conducted another experiment on the sample PDPs each having the following protective layer configurations and the following Xe gas concentrations: a dual-layer structure composed of the MgO film layer 81 and the MgO particle layer 82 with the Xe gas concentration of 15%; a single-layer structure composed of the MgO particle layer 82 with the Xe gas concentration of 100%; and a single-layer structure composed of the MgO particle layer 82 with the Xe gas concentration of 15%. By the experiment, it has been confirmed that the measurement results obtained on these sample PDPs all show similar behavior to the measurement results obtained on the sample PDP having a dual-layer structure composed of the MgO film layer 81 and the MgO particle layer 82 with the Xe gas concentration of 100%.

Experiment 5; Evaluation of Discharge Delay in Relation to Ratios of Spectrum Integral Values or of Peak Values of CL Spectrum Next, the present invention is evaluated based on the CL measurement results shown in Tables 3-6 and graphs shown in FIGS. 5-8 plotted from the CL measurement results. The MgO particles used in Experiment 5 were those selected out of MgO particles obtained through a burning process carried out at a temperature within a range of 700° C. and 2000° C., both inclusive. The selected MgO particles had a significant level of emission peak in the long-wavelength region of a CL spectrum. Based on the measurement results on the thus selected MgO particles (Sample Nos. 1-4), the ratios of spectrum integral values or of the peak values between the long and medium wavelength regions were calculated. The discharge delay times shown in FIGS. 5-8 are relative values, with the discharge delay time of Comparative Example not having an MgO particle layer being taken as unity.

FIG. 5 shows the discharge delay versus the ratio of the spectrum integral values of the long- to medium-wavelength regions (corresponding to the ratio a/b).

Table 3 shows the measurement values of Samples 1-4 and Comparative Example and those measurement values are used to plot the graph of FIG. 5.

TABLE 3

| | Ratio of Integral Values (a/b) | Relative Value of Discharge Delay |
|---|---|---|
| Comparative Example | 0 | 1.0 |
| Sample 1 | 1.2 | 0.11 |
| Sample 2 | 2.3 | 0.14 |
| Sample 3 | 7.0 | 0.23 |
| Sample 4 | 23 | 0.12 |

The experimental data shown in FIG. 5 and Table 3 indicates that the ratio of at least "1.2" or higher is preferable in order to achieve a substantial effect of suppressing discharge delay. When the ratio is equal to "2.3" or higher, the discharge delay is stably reduced to the extent beyond the characteristic dispersion within a single PDP. When the ratio is equal to "7" or higher, the discharge delay is stably reduced to the extent beyond the characteristic dispersion resulting from manufacturing tolerances among a plurality of PDPs. When the ratio reaches "23.0" or higher, the discharge delay is stably reduced to the extent beyond the characteristic dispersion within a single PDP and also among a plurality of PDPs observed during operation.

FIG. 5 also shows that the effect of suppressing discharge delay is maximum when the ratio is equal "1.2". It is also shown that the effect of discharge delay suppression varies as the ratio becomes higher than "1.2". It should be noted, however, that the variations are caused by, for example, the difference in ratio between the areas of the protective layer 8 covered and not covered by the MgO particles. Theory holds that the effect of suppressing discharge delay increase as the ratio is closer to "1.2".

FIG. 6 discussed below is a graph showing discharge delay versus the ratio of the spectrum integral values of the long-wavelength region to the wavelength region from 200 nm to 650 nm, exclusive of 650 nm (corresponding to the ratio a/c).

Table 4 shows the measurement values of Samples 1-4 and Comparative Example and those measurement values are used to plot the graph of FIG. 6.

TABLE 4

| | Ratio of Integral Values (a/c) | Relative Value of Discharge Delay |
|---|---|---|
| Comparative Example | 0 | 1.0 |
| Sample 1 | 0.9 | 0.11 |
| Sample 2 | 1.9 | 0.14 |
| Sample 3 | 4.5 | 0.23 |
| Sample 4 | 9.1 | 0.12 |

The experimental data shown in FIG. 6 and Table 4 indicates that the ratio of at least "0.9" or higher is preferable in order to achieve a substantial effect of suppressing discharge delay. When the ratio is equal to "1.9" or higher, the discharge delay is stably reduced to the extent beyond the characteristic dispersion within a single PDP. When the ratio is equal to "4.5" or higher, the discharge delay is stably reduced to the extent beyond the characteristic dispersion resulting from manufacturing tolerances among a plurality of PDPs. When the ratio reaches "9.1" or higher, the discharge delay is stably reduced to the extent beyond the characteristic dispersion within a single PDP and among a plurality of PDPs observed during operation.

FIG. 6 also shows that the effect of suppressing discharge delay is maximum when the ratio is equal to "0.9". It is also shown that the effect of discharge delay suppression varies as the ratio becomes higher than "0.9". It should be noted, however, that the variations are caused by the difference in ratio between the areas of the protective layer 8 covered and not covered by the MgO particles. Theory holds that the effect of suppressing discharge delay increase as the ratio is closer to "0.9".

FIG. 7 discussed below is a graph showing discharge delay versus the ratio of the peak values of the long- to medium-wavelength regions (corresponding to the ratio d/e).

Each ratio shown in FIG. 6 was calculated as follows. First, the portions of a CL spectrum corresponding to the long- and medium-wavelength regions were both plotted on a graph having the same set of spacing (the horizontal axis represents wavelength and the vertical axis represents the peak intensity). Next, the horizontal axis are divided into equal segments. In each segment, the respective totals of peak intensity values of the long- and medium-wavelength regions were calculated. Then, the total intensity value of the long-wavelength region was divided by the total intensity value of the medium-wavelength region to calculate the ratio.

Table 5 shows the measurement values of Samples 1-4 and Comparative Example and those measurement values are used to plot the graph of FIG. 7.

TABLE 5

| | Ratio of Peak Values (d/e) | Relative Value of Discharge Delay |
|---|---|---|
| Comparative Example | 0 | 1.0 |
| Sample 1 | 0.8 | 0.11 |
| Sample 2 | 1.7 | 0.14 |
| Sample 3 | 16 | 0.23 |
| Sample 4 | 24 | 0.12 |

The experimental data shown in FIG. 7 and Table 5 indicates that the ratio of at least "0.8" or higher is preferable in order to achieve a substantial effect of suppressing discharge delay. When the ratio is equal to "1.7" or higher, the discharge delay is stably reduced to the extent beyond the characteristic dispersion within a single PDP. When the ratio is equal to "16" or higher, the discharge delay is stably reduced to the extent beyond the characteristic dispersion resulting from manufacturing tolerances among a plurality of PDPs. When the ratio reaches "24" or higher, the discharge delay is stably reduced to the extent beyond the characteristic dispersion within a single PDP and among a plurality of PDPs observed during operation.

FIG. 7 also shows that the effect of suppressing discharge delay is maximum when the ratio is equal to "0.8". It is also shown the effect of discharge delay suppression varies as the ratio becomes higher than "0.8". It should be noted, however, that the variations are caused by the difference in ratio between the areas of the protective layer 8 covered and not covered by the MgO particles. Theory holds that the effect of suppressing discharge delay increase as the ratio is closer to "0.8".

FIG. 8 discussed below is a graph showing discharge delay versus the ratio of the peak values of the long-wavelength region to the wavelength region from 200 nm to 650 nm, exclusive of 650 nm (corresponding to the ratio d/f). Each ratio shown in FIG. 8 was calculated in a similar manner to those shown in FIG. 7.

Table 6 shows the measurement values of Samples 1-4 and Comparative Example and those measurement values are used to plot the graph of FIG. 8.

TABLE 6

| | Ratio of Peak Values (d/f) | Relative Value of Discharge Delay |
|---|---|---|
| Comparative Example | 0 | 1.0 |
| Sample 1 | 0.8 | 0.11 |
| Sample 2 | 1.7 | 0.14 |
| Sample 3 | 5.0 | 0.23 |
| Sample 4 | 12 | 0.12 |

The experimental data shown in FIG. 8 and Table 6 indicates that the ratio of at least "0.8" or higher is preferable in order to achieve a substantial effect of suppressing discharge delay.

When the ratio is equal to "1.7" or higher, the discharge delay is stably reduced to the extent beyond the characteristic dispersion within a single PDP. When the ratio is equal to "5" or higher, the discharge delay is stably reduced to the extent beyond the characteristic dispersion resulting from manufacturing tolerances among a plurality of PDPs. When the ratio reaches "12" or higher, the discharge delay is stably reduced to the extent beyond the characteristic dispersion within a single PDP and among a plurality of PDPs observed during operation.

FIG. 8 also shows that the effect of suppressing discharge delay is maximum when the ratio is equal to "0.8". It is also shown the effect of the effect of discharge delay suppression varies as the ratio becomes higher than "0.8". It should be noted, however, that the variations are caused by the difference in ratio between the areas of the protective layer 8 covered and not covered by the MgO particles. Theory holds that the effect of suppressing discharge delay increase as the ratio is closer to "0.8".

In light of the above, the superiority of the present invention has been confirmed.

(Supplemental Note)

According to Embodiment 1, the protective layer 8 is composed of the MgO film layer 81 and the MgO particle layer 82 that are laid on the dielectric layer 7 in the stated order. It should be naturally appreciated, however, that the configuration of the protective layer is not limited to such. FIG. 9 are enlarged views each showing a variation of the protective layer 8.

FIG. 9A shows Variation 1 according to which a plurality of MgO particles among the MgO particles 16 of the MgO particle layer 82 are partially embedded in the MgO film layer 81. With Variation 1, an effect substantially comparable to that of Embodiment 1 is still achieved. In addition, Variation 1 achieves an additional effect that the MgO particles 16 more firmly adhere to the MgO film layer 81, so that detachment of the MgO particles 16 from the MgO film layer 81 is prevented even upon receiving vibration or shock.

FIG. 9B shows Variation 2 according to which the protective layer 8 is composed solely of the MgO particle layer 82 formed by scattering MgO particles 16 directly onto the dielectric layer.

With Variation 2, an effect substantially comparable to that of Embodiment 1 is still achieved. In addition, since the MgO film layer 81 is omitted, it is no longer required to perform a thin-film method involving sputtering, ion plating, or electron beam deposition. This leads to an additional effect of saving manufacturing steps and manufacturing cost.

Similarly to Embodiment 1, it is still preferable with Variation 2 that the area of the dielectric layer covered by the MgO particles is smaller than an area of the dielectric layer exposed to the discharge space. That is, it is not necessary that the MgO particles 16 are disposed to cover the entire surface of the dielectric layer. Rather, it is preferable that the MgO particles 16 are disposed like a plurality of separate islands on the surface of the dielectric layer.

According to one method having been studied, an MgO protective layer is formed by printing a paste of magnesium salt on a dielectric glass layer, followed by burning (See Patent Document 10). Unfortunately, however, it is known that the discharge characteristics of a PDP having such an MgO protective layer show little or no improvement, as compared with a PDP having an MgO protective layer formed by vacuum deposition. According to the vacuum deposition, magnesium oxide is heated by an electron beam to cause deposition.

INDUSTRIAL APPLICABILITY

PDPs according to the present invention are applicable, for example, to display devices of television sets and computers used in transport facilities, public facilities, and households.

REFERENCE NUMERALS

Reference Numerals

Figure 1:
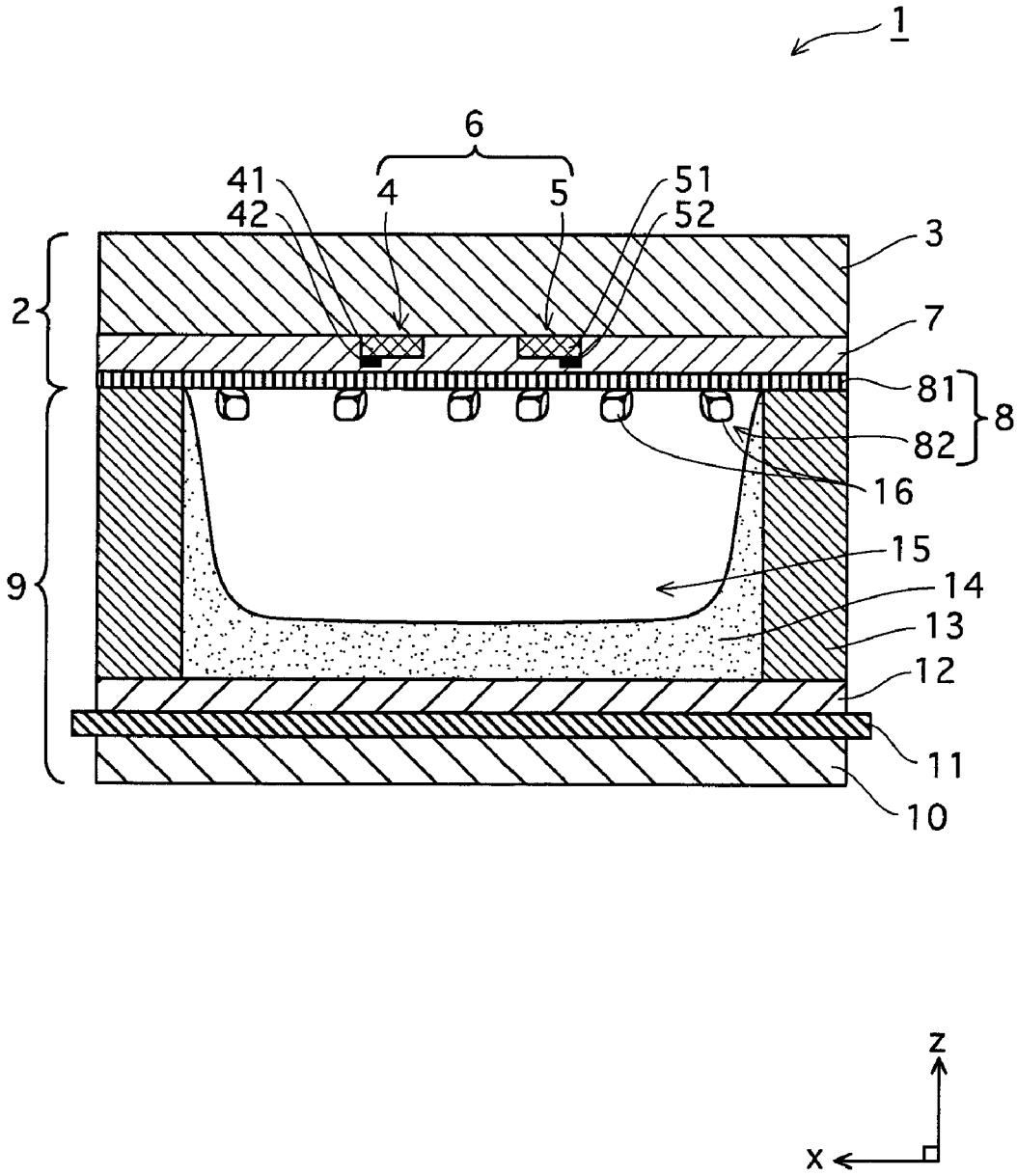
FIG. 1 is a schematic cross sectional view of a PDP 1 according to the present invention.
Figure 2:
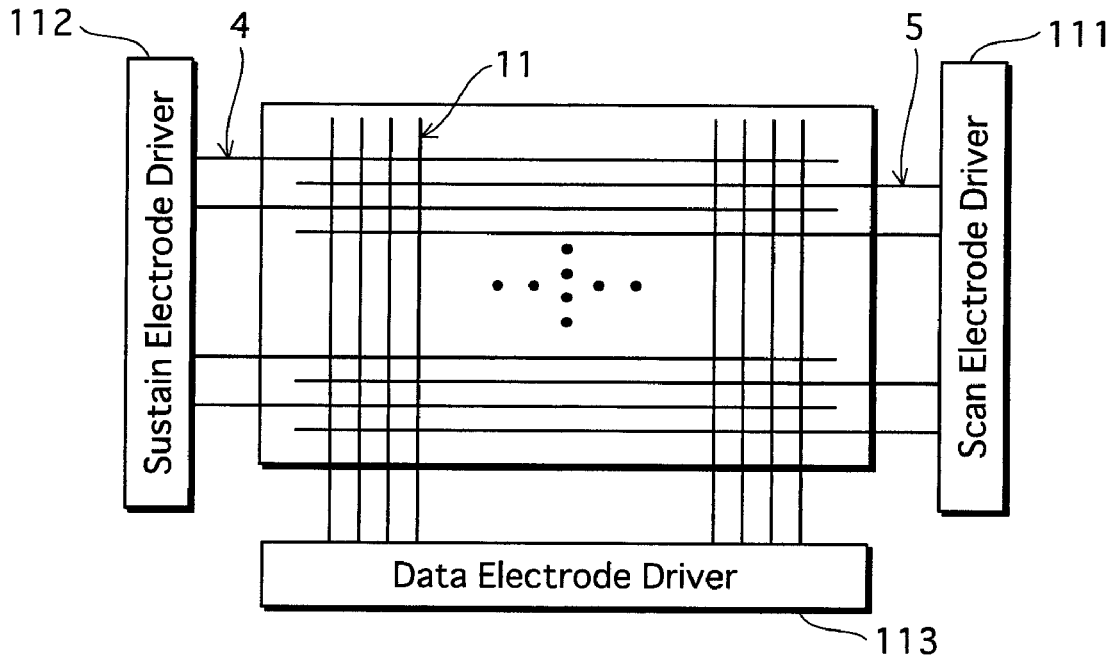
FIG. 2 is a schematic view of the connection between electrodes and drivers.
Figure 3:
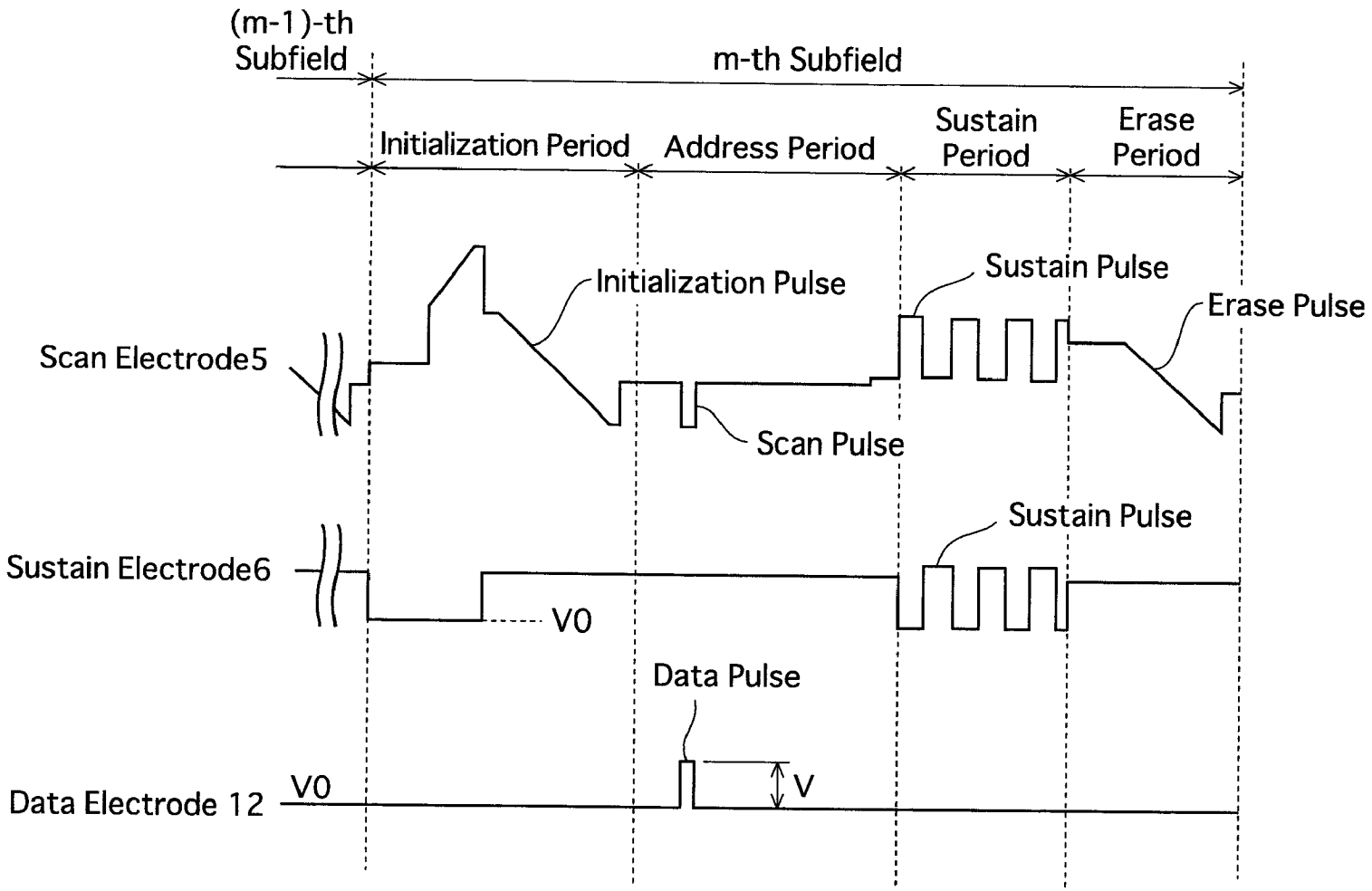
FIG. 3 is a view showing an example of PDP driving waveforms.
Figure 4:
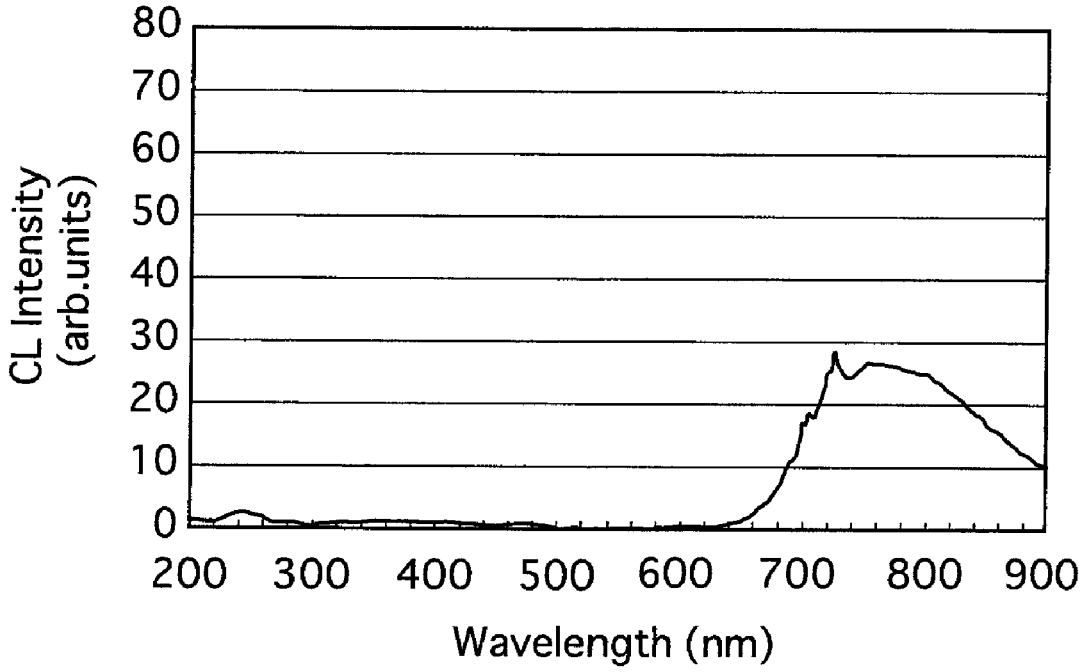
FIG. 4 is a graph of CL measurement results showing the properties of a protective layer.
Figure 5:
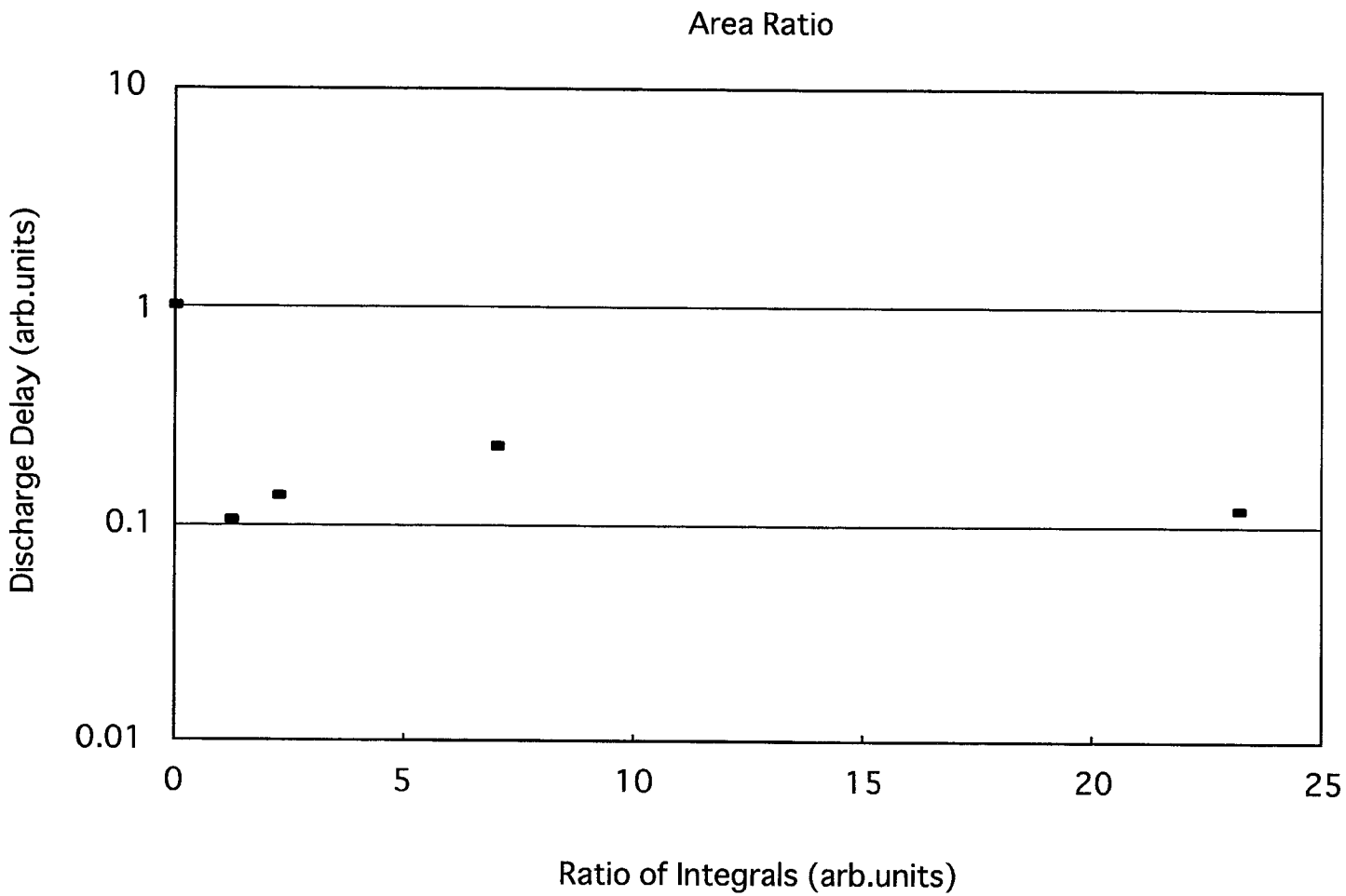
FIG. 5 is a graph showing discharge delay versus the ratio of spectrum integral values of a CL spectrum.
Figure 6:
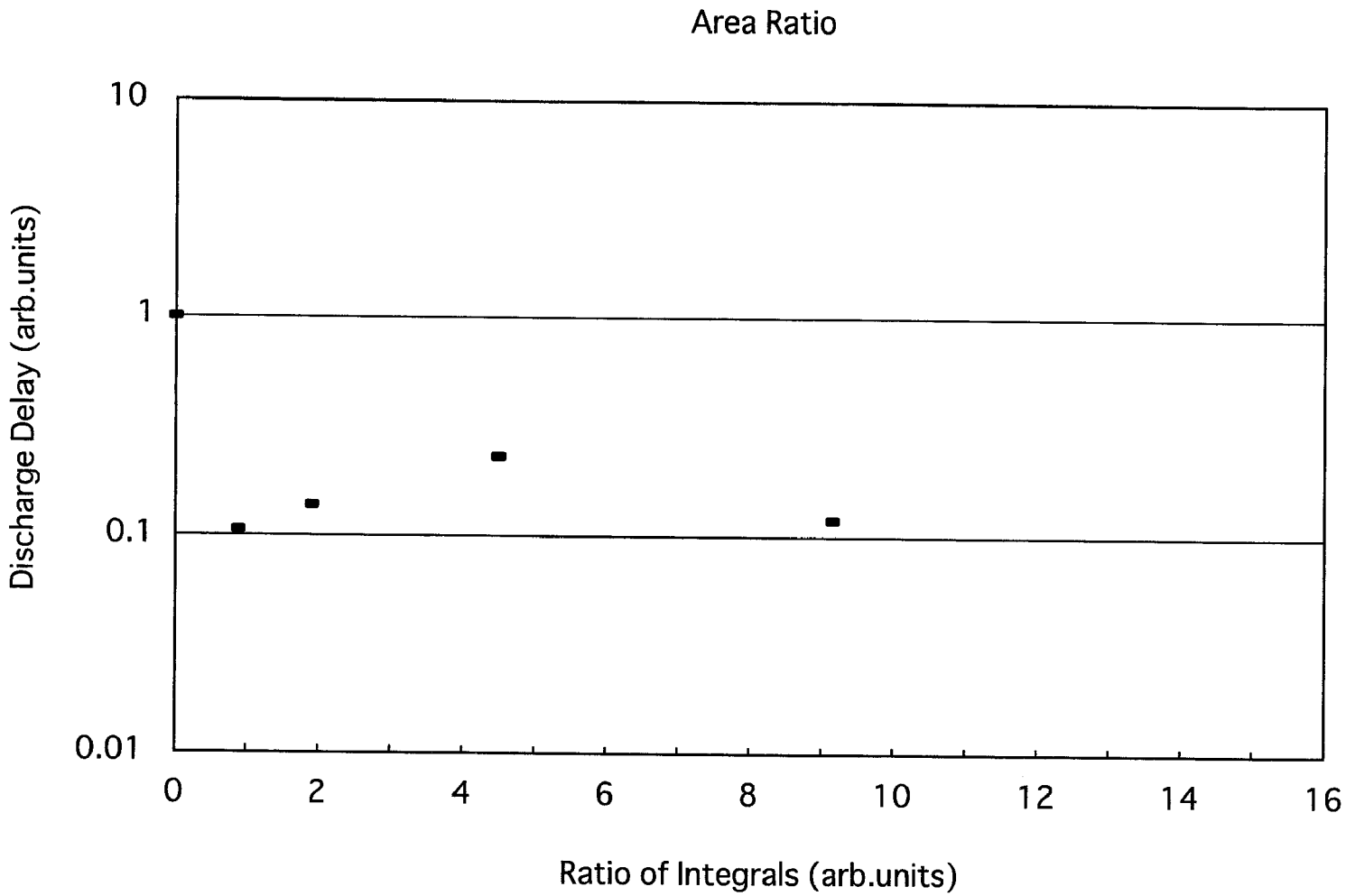
FIG. 6 is a graph showing discharge delay versus the ratio of spectrum integral values of a CL spectrum.
Figure 7:
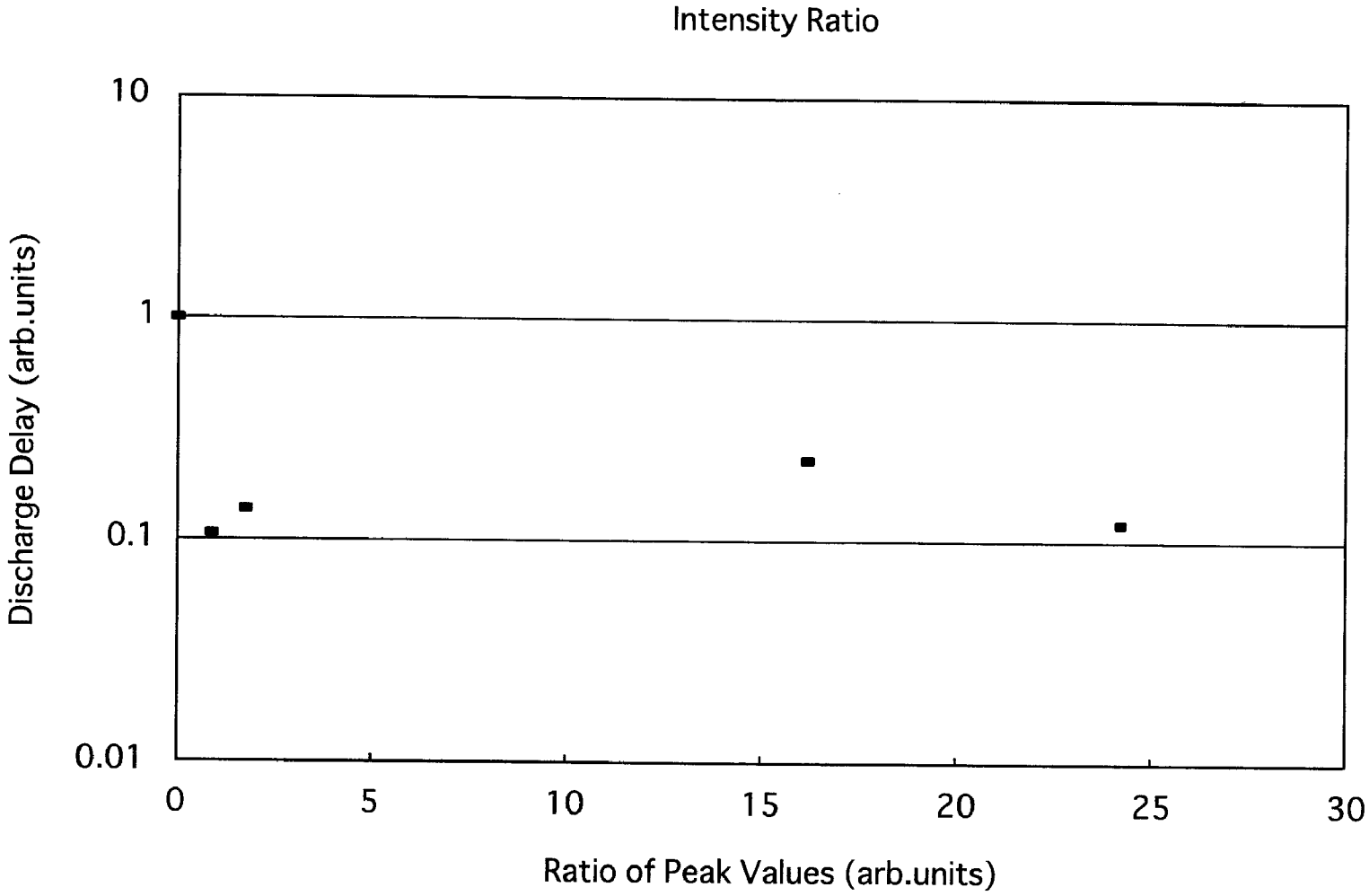
FIG. 7 is a graph showing discharge delay versus the ratio of CL spectrum peak values.
Figure 8:
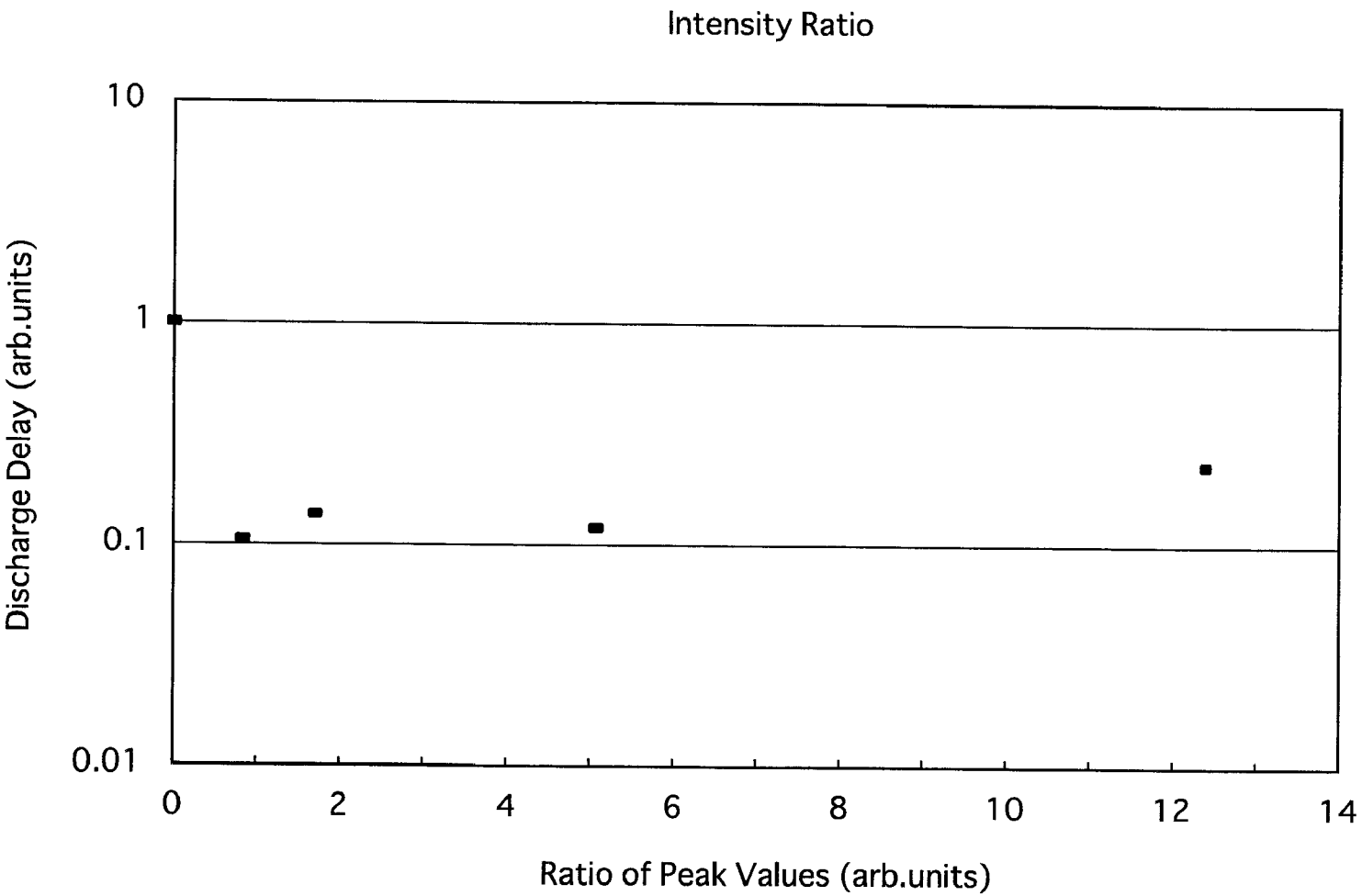
FIG. 8 is a graph showing discharge delay versus the ratio of CL spectrum peak values.
Figure 9A:
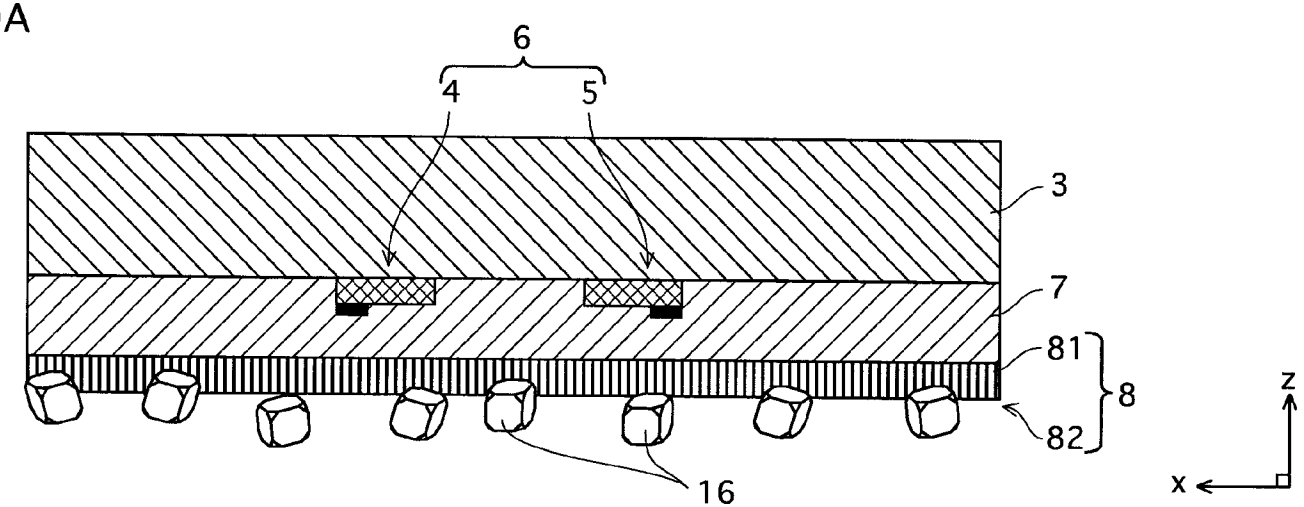
FIG. 9 are schematic views of variations of the protective layer.
Figure 9B:
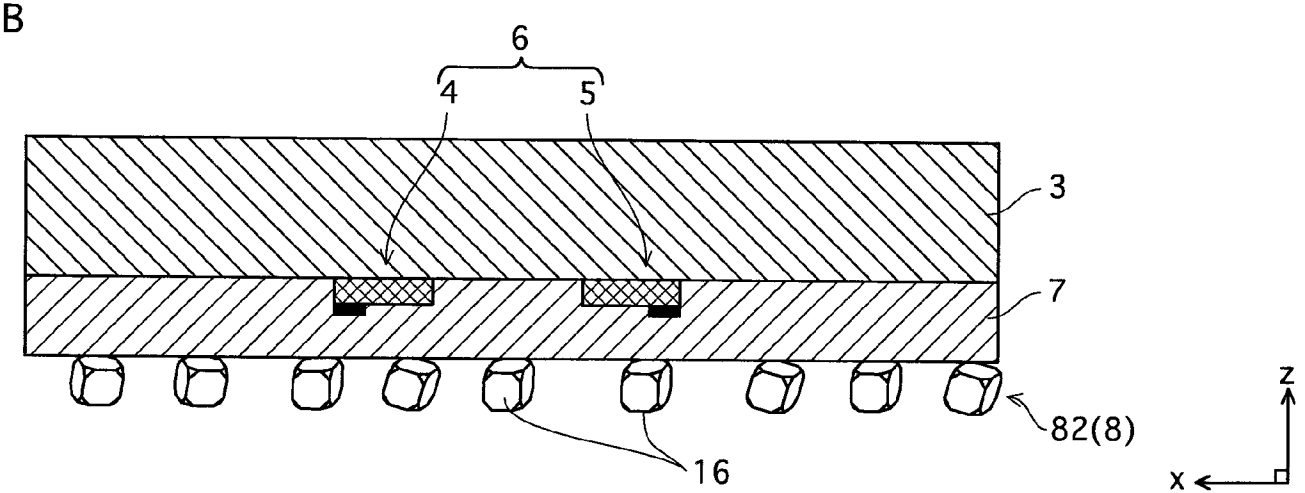
Figure 10:
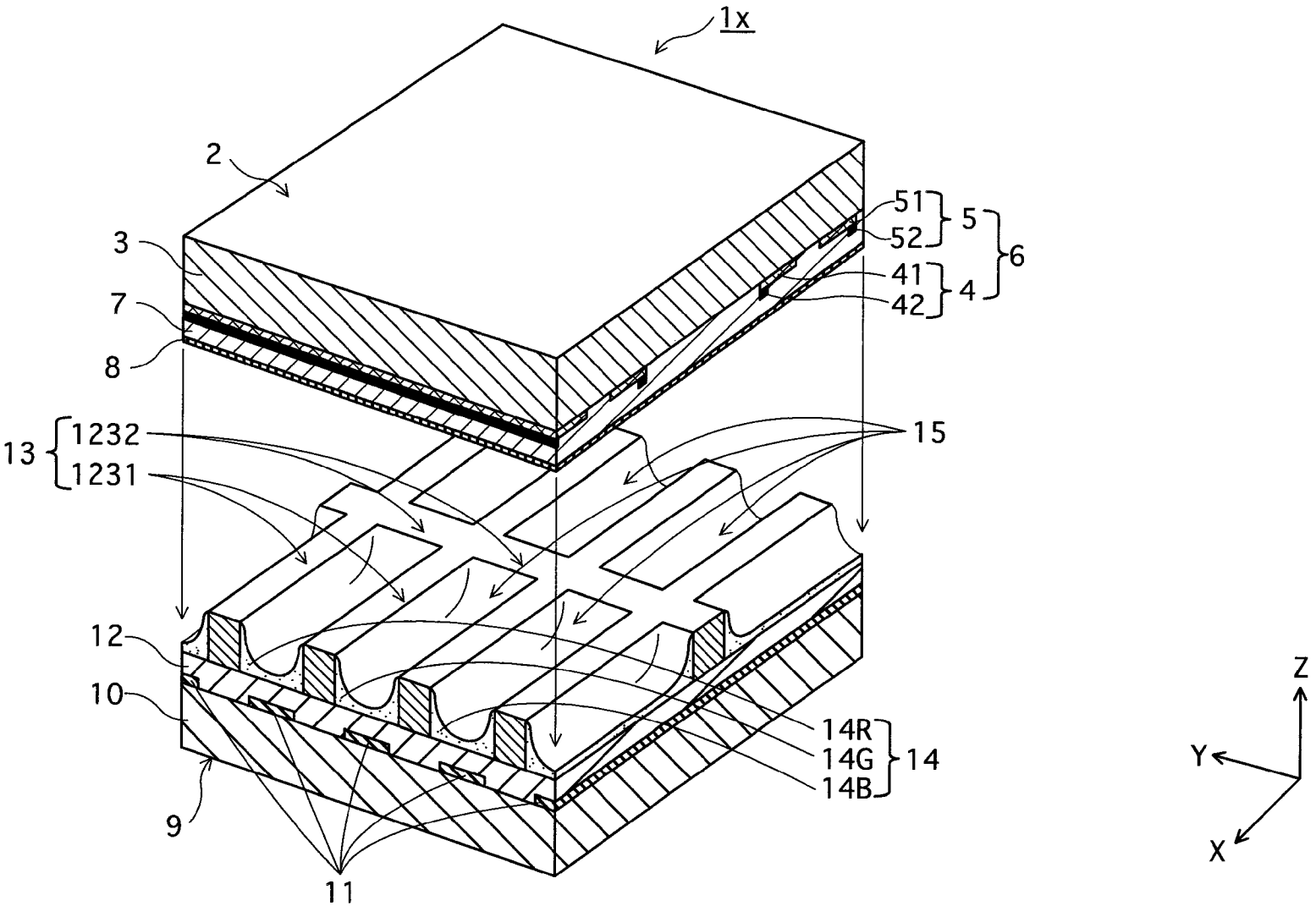
FIG. 10 is an assembly drawing schematically showing the structure of a prevalent PDP.
Figure 11:
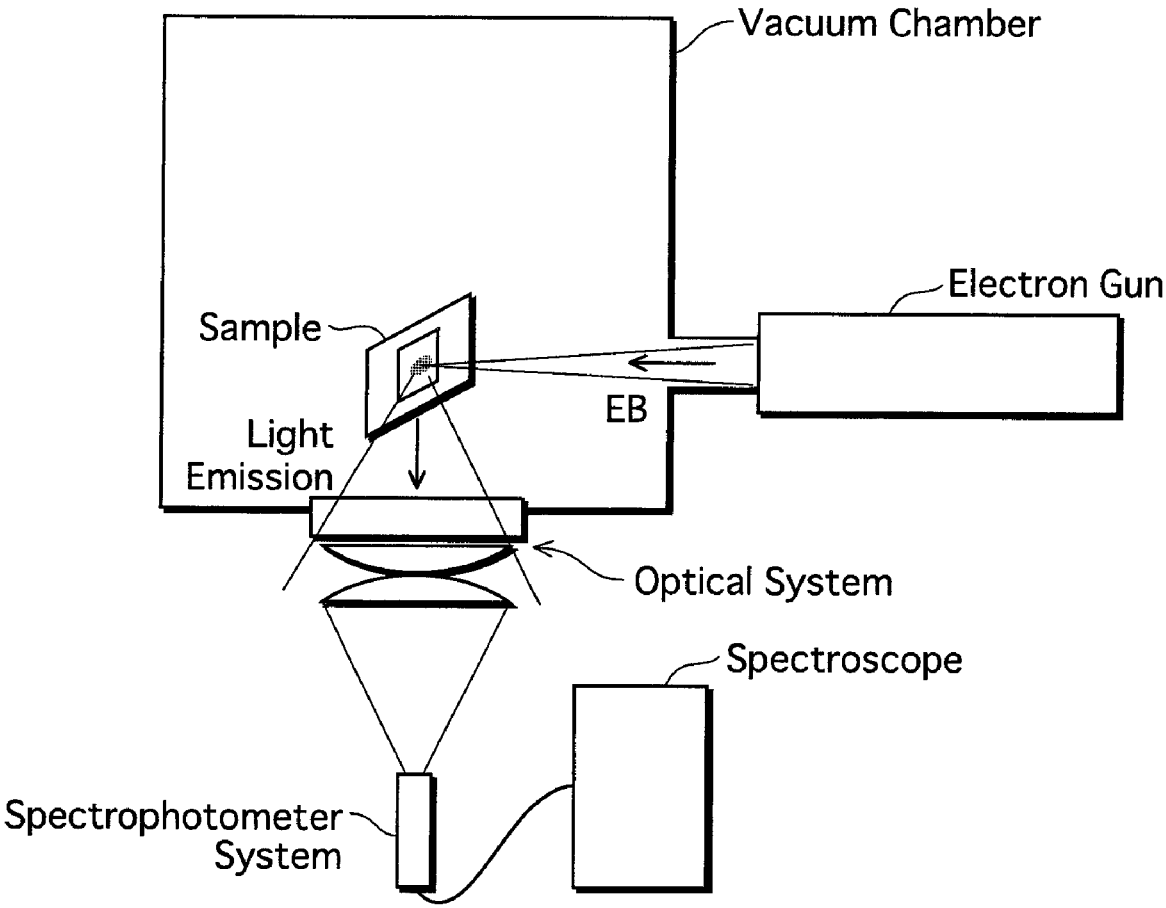
FIG. 11 is a view schematically showing spectrophotometric measurement carried out with a high-sensitivity spectrophotometer system.

1, 1*x* PDP
2 Front Panel
8 Protective Layer
15 Discharge Space
16 MgO Particles
81 MgO Film
82 MgO Particle Layer

The invention claimed is:

1. A plasma display panel comprising:

a first substrate;

a plurality of electrodes, a dielectric layer, and a protective layer that are laid on the first substrate in the stated order; and a second substrate opposed to the first substrate, with the protective layer facing toward a discharge space, wherein the protective layer includes crystal particles disposed in a layer that is exposed to the discharge space at least partially, and the crystal particles include MgO particles satisfying a condition that a ratio of a/b is equal to 1.2 or higher, where a denotes a spectrum integral value of a portion of a cathodoluminescence spectrum corresponding to a wavelength region of 650 nm to 900 nm, exclusive of 900 nm, and b denotes a spectrum integral value of a portion of the cathodoluminescence spectrum corresponding to a wavelength region of 300 nm to 550 nm, exclusive of 550 nm.

2. The plasma display panel according to claim 1, wherein the ratio is equal to 2.3 or higher.

3. The plasma display panel according to claim 1, wherein the ratio is equal to 7 or higher.

4. The plasma display panel according to claim 1, wherein the ratio is equal to 23 or higher.

5. A plasma display panel comprising:

a first substrate;

a plurality of electrodes, a dielectric layer, and a protective layer that are laid on the first substrate in the stated order; and a second substrate opposed to the first substrate, with the protective layer facing toward a discharge space, wherein the protective layer includes crystal particles disposed in a layer that is exposed to the discharge space at least partially, and the MgO particles satisfy a condition that a ratio of a/c is equal to 0.9 or higher, where within a portion of the cathodoluminescence spectrum corresponding to a wavelength region of 200 nm to 900 nm exclusive of 900 nm, a denotes the spectrum integral value of the portion of the cathodoluminescence spectrum corresponding to the wavelength region of 650 nm to 900 nm, exclusive of 900 nm, and c denotes a spectrum integral value of a portion of the cathodoluminescence spectrum corresponding to a wavelength region of 200 nm to 650 nm, exclusive of 650 nm.

6. The plasma display panel according to claim 5, wherein the a/c ratio is equal to 1.9 or higher.

7. The plasma display panel according to claim 5, wherein the a/c ratio is equal to 4.5 or higher.

8. The plasma display panel according to claim 5, wherein the a/c ratio is equal to 9.1 or higher.

9. A plasma display panel comprising:

a first substrate;

a plurality of electrodes, a dielectric layer, and a protective layer that are laid on the first substrate in the stated order; and a second substrate opposed to the first substrate, with the protective layer facing toward a discharge space, wherein the protective layer includes crystal particles disposed in a layer that is exposed to the discharge space at least partially, and the crystal particles include MgO particles satisfying a condition that a ratio of d/e is equal to 0.8 or higher, where d denotes a peak value in a portion of a cathodoluminescence spectrum corresponding to a wavelength region of 650 nm to 900 nm, exclusive of 900 nm, and e denotes a peak value in a portion of the cathodoluminescence spectrum corresponding to a wavelength region of 300 nm to 550 nm, exclusive of 550 nm.

10. The plasma display panel according to claim 9, wherein the ratio is equal to 1.7 or higher.

11. The plasma display panel according to claim 9, wherein the ratio is equal to 16 or higher.

12. The plasma display panel according to claim 9, wherein the ratio is equal to 24 or higher.

13. A plasma display panel comprising:

a first substrate;

a plurality of electrodes, a dielectric layer, and a protective layer that are laid on the first substrate in the stated order; and a second substrate opposed to the first substrate, with the protective layer facing toward a discharge space, wherein the protective layer includes crystal particles disposed in a layer that is exposed to the discharge space at least partially, and the MgO particles satisfy a condition that a ratio of d/f is equal to 0.8 or higher, where within a portion of the cathodoluminescence spectrum corresponding to a wavelength region of 200 nm to 900 nm exclusive of 900 nm, d denotes the peak value in the portion of the cathodoluminescence spectrum corresponding to the wavelength region of 650 nm to 900 nm, exclusive of 900 nm, and f denotes a peak value in a portion of the cathodoluminescence spectrum corresponding to a wavelength region of 200 nm to 650 nm, exclusive of 650 nm.

14. The plasma display panel according to claim 13, wherein the d/f ratio is equal to 1.7 or higher.

15. The plasma display panel according to claim 13, wherein the d/f ratio is equal to 5 or higher.

16. The plasma display panel according to claim 13, wherein the d/f ratio is equal to 12 or higher.

17. The plasma display panel according to claim 1, wherein the protective layer includes an MgO film and the crystal particle layer that are laid in the stated order.

18. The plasma display panel according to claim 1, wherein the MgO particles of the crystal particle layer include MgO particles that are partially embedded in the MgO film.

19. The plasma display panel according to claim 1, wherein the protective layer is composed of the crystal particle layer disposed directly on the dielectric layer.

* * * * *